US011752534B2

(12) United States Patent
Khoda et al.

(10) Patent No.: US 11,752,534 B2
(45) Date of Patent: Sep. 12, 2023

(54) AUTOMATIC METAL WIRE BENDING (AMWB) APPARATUS TO MANUFACTURE SHAPE CONFORMING LATTICE STRUCTURE WITH CONTINUUM DESIGN FOR MANUFACTURABLE TOPOLOGY

(71) Applicant: NDSU Research Foundation, Fargo, ND (US)

(72) Inventors: Bashir Khoda, Fargo, ND (US); Nazmul Ahsan, Fargo, ND (US); Md Habib, Fargo, ND (US); Ruinan Xie, Fargo, ND (US)

(73) Assignee: NDSU RESEARCH FOUNDATION, Fargo, ND (US)

( * ) Notice: Subject to any disclaimer, the term of this patent is extended or adjusted under 35 U.S.C. 154(b) by 0 days.

(21) Appl. No.: 16/711,364

(22) Filed: Dec. 11, 2019

(65) Prior Publication Data

US 2020/0180004 A1 Jun. 11, 2020

Related U.S. Application Data

(60) Provisional application No. 62/778,110, filed on Dec. 11, 2018.

(51) Int. Cl.
*B21D 7/08* (2006.01)
*B21D 7/12* (2006.01)

(52) U.S. Cl.
CPC ..... *B21D 7/08* (2013.01); *B21D 7/12* (2013.01)

(58) Field of Classification Search
CPC . B21D 7/08; B21D 7/085; B21D 7/12; B21D 7/00; B21D 43/006; B21F 1/006; B21F 1/00; B21F 3/00; B21F 3/02; B21F 3/04; B21F 3/06; B21F 23/00
See application file for complete search history.

(56) References Cited

U.S. PATENT DOCUMENTS 5,088,310 A * 2/1992 Anagnostopoulu ..... B21D 7/12 72/217
5,117,668 A * 6/1992 Philpot ..... B21F 3/00 72/135

(Continued)

FOREIGN PATENT DOCUMENTS

KR 20150052636 A * 5/2015 ..... B21D 3/02

OTHER PUBLICATIONS

KR 20150052636 A Machine Translation, 2015 (Year: 2015).*

(Continued)

*Primary Examiner* — Teresa M Ekiert
(74) *Attorney, Agent, or Firm* — Stites & Harbison, PLLC; Mandy Wilson Decker

(57) ABSTRACT

Provided herein are an apparatus and method for bending wire. The apparatus includes a feeding system with at least one feed roller pair and a controllable feed motor, at least one control platform axis, and at least one bending unit. The method includes i) providing the apparatus of claim 1; ii) advancing a wire with the feeding system; iii) engaging the wire with the at least one bending unit; iv) bending the wire with the at least one bending unit; v) retracting the at least one bending unit; and optionally repeating steps ii-v to form a desired structure. Also provided herein are algorithms for feeding, engaging, and bending the wire.

15 Claims, 30 Drawing Sheets

(56) References Cited

U.S. PATENT DOCUMENTS

| | | | | | |
|---|---|---|---|---|---|
| 5,685,186 | A * | 11/1997 | Flemmer | B21F 1/00 | 29/20 |
| 5,875,666 | A * | 3/1999 | Itaya | B21F 3/02 | 72/140 |
| 2002/0030321 | A1* | 3/2002 | Sugiyama | H04N 1/00578 | 271/226 |
| 2007/0234775 | A1* | 10/2007 | Speck | B21D 7/12 | 72/305 |
| 2008/0184761 | A1* | 8/2008 | Hammerer | B21D 7/12 | 72/306 |
| 2010/0307213 | A1* | 12/2010 | Veit | B21D 7/12 | 72/294 |
| 2016/0332212 | A1* | 11/2016 | Yang | B21F 3/06 | |
| 2017/0312808 | A1* | 11/2017 | Suto | B21F 1/008 | |
| 2018/0036781 | A1* | 2/2018 | Tang | B21F 1/00 | |
| 2019/0168286 | A1* | 6/2019 | Mirtaheri | B21F 11/00 | |
| 2020/0346274 | A1* | 11/2020 | Jung | B21F 23/00 | |

OTHER PUBLICATIONS

Mun, J., et al. Indirect additive manufacturing based casting of a periodic 3D cellular metal—Flow simulation of molten aluminum alloy, 17 Journal of Manufacturing Processes 28-40 (2015).

Queheillalt, D.T., et al. Titanium alloy lattice truss structures, 30 Materials & Design 1966-1975 (2009).

Schaedler, T.A., et al. Ultralight Metallic Microlattices, 334(6058) Science 962-965 (2011).

Sennewald, C., et al. Metal Sandwiches and Metal-Matrix-Composites Based on 3D Woven Wire Structures for Hybrid Lightweight Construction, 16(10) Advanced Engineering Materials 1234-1242 (2014).

Wadley, H.N.G., et al. Impact response of aluminum corrugated core sandwich panels, 62 International Journal of Impact Engineering 114-128 (2013).

Zheng, X., et al. Ultralight, ultrastiff mechanical metamaterials, 344(6190) Science 1373-1377 (2014).

* cited by examiner

Algorithm 1: Image/CAD Data Extraction

Input : Set of images $\mathbf{Img} = \{I\}$.

Output : Set of fitted parametric curves $\mathbf{C}_x = \{\mathbf{C}(u)^x\}$, $\mathbf{C}_y = \{\mathbf{C}(u)^y\}$.

$[P_{x,y}] \leftarrow I$ $[1,\ldots,l] \leftarrow [1,\ldots,M] \times [1,\ldots,N]$ // image quantization $I' \leftarrow [1,\ldots,l]$ $[P'_{x,y}] \leftarrow I'$ $\overline{P}_x \leftarrow \frac{1}{N_y} \sum_y P'_{x,y}$ $\overline{P}_y \leftarrow \frac{1}{N_x} \sum_x P'_{x,y}$ $\mathbf{XP} \leftarrow \{(x, \overline{P}_x)\}$ $\mathbf{YP} \leftarrow \{(y, \overline{P}_y)\}$ $\mathbf{C}_x, \mathbf{C}_y \leftarrow \phi$ $\mathbf{SXP}, \mathbf{SYP} \leftarrow \phi$ $\mathbf{Q} \leftarrow \phi$ $\overline{\mathbf{Q}} \leftarrow \mathbf{XP}$ $u \in [0,1]$ while $|Q| < |XP|$ do

$\mathbf{SXP} \leftarrow \{(x, P'_x)_j : (x, P'_x)_j \in \overline{Q}, j = 1,\ldots,s-1\}$ $\mathbf{C}(u)^x \leftarrow \sum B(u) \cdot \mathbf{SXP}$ $E \leftarrow Error(\mathbf{SXP}, \mathbf{C}(u)^x)$ $\mathbf{Q} \leftarrow \mathbf{Q} \cup \mathbf{SXP}$

FIG. 12

```
    Q̄ ← Q̄ \ SXP
    while E < E_thr and |Q| < |XP| do
        SXP ← {(x, P'_x)_j : (x, P'_x)_j ∈ Q̄, j = 1,...,s−1}
        C(u)^x ← Σ B(u) · SXP
        E ← Error(SXP, C(u)^x)
        Q ← Q ∪ SXP
        Q̄ ← Q̄ \ SXP
    end
    C_x ← C_x ∪ C(u)^x
end
Q ← φ
Q̄ ← YP
u ∈ [0,1]
while |Q| < |YP| do
    SYP ← {(y, P'_y)_j : (y, P'_y)_j ∈ Q̄, j = 1,...,s−1}
    C(u)^y ← Σ B(u) · SYP
    E ← Error(SYP, C(u)^y)
    Q ← Q ∪ SYP
    Q̄ ← Q̄ \ SYP
    while E < E_thr and |Q| < |YP| do
        SYP ← {(y, P'_y)_j : (y, P'_y)_j ∈ Q̄, j = 1,...,s−1}
        C(u)^y ← Σ B(u) · SYP
```

FIG. 12

(Continued)

```
        E ← Error(SYP, C(u)^y)
        Q ← Q ∪ SYP
        Q̄ ← Q̄ \ SYP
    end
    C_y ← C_y ∪ C(u)^y
end
return C_x, C_y
```

FIG. 12

(Continued)

Algorithm 2: Object Voxelization

Input : Set of fitted parametric curves $\mathbf{C}_x = \{\mathbf{C}(u)^x\}$, $\mathbf{C}_y = \{\mathbf{C}(u)^y\}$.

Output : Voxelized Object $\mathbf{V}$.

$\mathbf{L}_x \leftarrow \phi$ $\mathbf{L}_y \leftarrow \phi$ $x \leftarrow 0$ while $x < \|(X_{max}, Y_{min}) - (X_{min}, Y_{min})\|$ do

$\hat{P}_x \leftarrow \{\mathbf{C}(u)^x\}$ $l_x \leftarrow f(D, \hat{P}_x)$ $\mathbf{L}_x \leftarrow \mathbf{L}_x \cup \{l_x\}$ $x \leftarrow x + l_x$

End

$y \leftarrow 0$ while $y < \|(X_{min}, Y_{max}) - (X_{min}, Y_{min})\|$ do

$\hat{P}_y \leftarrow \{\mathbf{C}(u)^y\}$ $l_y \leftarrow f(D, \hat{P}_y)$ $\mathbf{L}_y \leftarrow \mathbf{L}_y \cup \{l_y\}$ $y \leftarrow y + l_y$ end

$\mathbf{V} \leftarrow \{\mathbf{L}_x, \mathbf{L}_y\}$ return V

FIG. 13

Algorithm 3: Lattice Fitting

Input : Voxelized Object $\mathbf{V}$, Lattice type (e.g., Cubic, BCC, Honeycomb etc.).

Output : 3D Lattice Structure $\mathbf{LS}$, 3D Lattice Structure Vertices $\mathbf{LV}$.

```
{nl, nx, ny} ← size(V)
LV ← ϕ
LS ← ϕ
for i = 1 to nl
    for j = 1 to nx
        for k = 1 to ny
            LV ← LV ∪ sequential vertices of V(i, j, k) according to lattice type
        next
    next
next
LS ← polyline(LV)
return LS , LV
```

FIG. 14

Algorithm 4: Continuous Bending Path Generation

Input : 3D Lattice Structure Vertices LV.

Output : Continuous Toolpath TP.

```
TV ← ϕ
TP ← ϕ
FL ← 0
β ← 0
CP ∈ {1,2,3,4}
for i = 1 to size(LV) − 1
    TV ← TV ∪ LV_i LV_{i+1}→      //toolpath vector
end
for i = 1 to size(TV) − 1
    FL ← ‖TV_i‖                   //wire feed length
    β ← angle (TV_i, TV_{i+1})    //bend angle
    CP ← ControlAxis (TV, FL, β)  //control axis selection
    TP ← TP ∪ {FL, β, CP}
end
return TP
```

FIG. 15

| | Cellular structure manufacturing method | | | | |
|---|---|---|---|---|---|
| | Foam | Additive Manufacturing /3D printing | Strurwire/Wire-woven metal | Constructed lattice (Sheet forming, casting and joining brazing, laser etc.) | AMWB structure |
| Aperiodic Configuration | | | | | |
| Lattice Pattern | Random pattern | Multiple pattern within and between layer is achievable | Single pattern | Single pattern | Multiple patterns within and between layer is achievable |
| Controllable Heterogeneity/ Topology based Progressivity/ Aperiodicity | Not Achievable | Achievable | Not Achievable | Not Achievable | Achievable |
| Object Shape Conformity | Cut-to-fit | Shape conforming | Cut-to-fit | Cut-to-fit | Shape conforming |
| Other Configuration | | | | | |
| Manufacturing Steps | Multi-stage, complex process | Single or two stage depending upon the process | Multi-stage, complex process, Assembly required | Multi-stage complex process, Assembly required | Two-step Bonding and Brazing |
| Material Recycling | Very much limited | Limited to None | Limited to None | Limited to None | Direct |
| In-situ Design Reconfiguration | Not possible | Achievable with digital thread | Not possible | Not possible | Achievable with digital thread |
| Form of Material | Liquid or solid | Powder, wire or liquid | Discrete wire | Discrete wire | Continuous wire |
| Strength of Structure | Low to medium | Low to medium | High | High | Low to medium |
| Number of Joining Nodes | n/a | Virtually infinite | Significantly high | High | Minimal |
| Multilayer structure | Limited-By stacking | Achievable | Achievable | Limited-By stacking single layer | Achievable |

FIG. 21

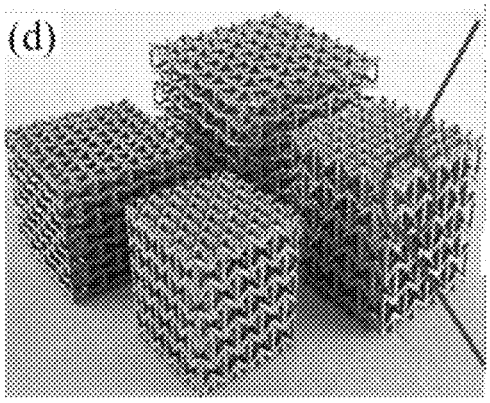
FIG. 22D
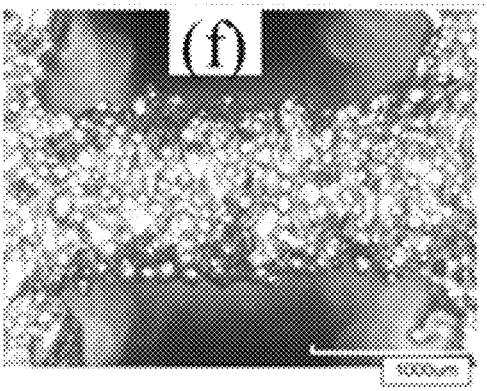
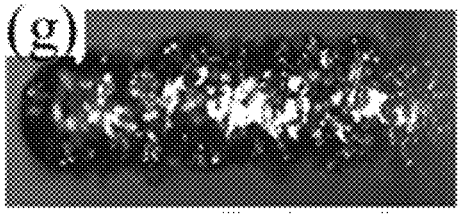
FIG. 22E
FIG. 22F
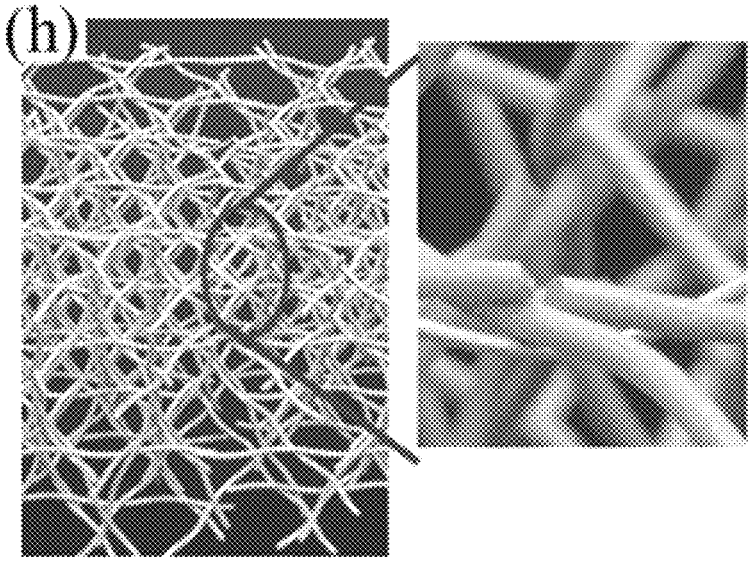
FIG. 22G
FIG. 22H

AUTOMATIC METAL WIRE BENDING (AMWB) APPARATUS TO MANUFACTURE SHAPE CONFORMING LATTICE STRUCTURE WITH CONTINUUM DESIGN FOR MANUFACTURABLE TOPOLOGY

RELATED APPLICATIONS

This application claims the benefit of U.S. Provisional Application Ser. No. 62/778,110, filed Dec. 11, 2018, the entire disclosure of which is incorporated herein by this reference.

TECHNICAL FIELD

The presently-disclosed subject matter generally relates to an apparatus and methods for bending wire. In particular, certain embodiments of the presently-disclosed subject matter relate to an automatic metal wire bending apparatus and methods for forming structures using the same.

BACKGROUND

Even with the progress of three-dimensional printing, there are few alternatives for producing a two or three dimensional scaffolds or lattices to be used as the support structure for a two or three-dimensional (2D or 3D) objects. Such objects can be lightweight yet still have a desired strength and flexibility without having to be solid objects. For example, aircraft wings and automobile doors have strategic lightweight frameworks upon which a metal is attached. There are many other examples of products that comprise a framework with a covering, shell, skin or coating. However, such frameworks usually are manufactured as components and then assembled by hand or robotically resulting in a framework or lattice. Even if the framework or lattice is made from one continuous linear material, it needs to be bent by hand-tools or manual tool to result in a two or three-dimensional scaffold that can serve as the framework or lattice for a two or three-dimensional object.

For example, Kuwayama et al. (U.S. Pat. No. 8,511,135) discloses a pipe bending device for bending pipe. The device: 1) is an intermittent bending system, 2) has a feed mechanism that is a vertically articulated robot, 3) has bending diameters that are limited by the roller-dies, 4) has a bending radius that is not sharp due to its roller-die bending mechanism, 5) has a wire diameter that is restricted by the end effecter and roller-dies, and 6) is not intended for 3D functional structure.

In addition, Broggi et al. (U.S. Pat. No. 6,434,993) discloses a device for bending threadlike material such as tubes, rods, profiles or metal wire. The device: 1) focuses on bending tubes, rods, or metal wire, 2) has bending dies with different diameter to make different bending diameters, 3) has a bending radius that is not sharp due to its roller-die bending mechanism, 4) has wire diameters that are restricted to some extent, 5) has changing roller-die bending assemblies that are time consuming and not easily interchangeable, and 6) is not intended for 3D functional structure.

To date, there are no devices that can bend a linear material rapidly, in multiple axes, in multiple and diverse configurations, and with any size diameter linear material. Accordingly, there remains a need in the art for such devices.

SUMMARY

The presently-disclosed subject matter meets some or all of the above-identified needs, as will become evident to those of ordinary skill in the art after a study of information provided in this document.

This summary describes several embodiments of the presently-disclosed subject matter, and in many cases lists variations and permutations of these embodiments. This summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this summary or not. To avoid excessive repetition, this summary does not list or suggest all possible combinations of such features.

In some embodiments, the presently-disclosed subject matter includes a wire bending apparatus including a feeding system, at least one control platform axis, and at least one bending unit. In some embodiments, the feeding system comprises at least one feed roller pair and a controllable feed motor. In one embodiment, the at least one feed roller pair comprises a first feed roller pair and a second feed roller pair. In one embodiment, each feed roller pair includes a primary roller coupled to a pulley and a secondary roller coupled to a top plate of the wire bending apparatus. In another embodiment, a drive belt couples the pulley to the controllable feed motor. In one embodiment, each feed roller pair includes a primary roller coupled to a gear and a secondary roller coupled to a top plate of the wire bending apparatus. In another embodiment, the gear engages directly with the controllable feed motor.

In some embodiments, the at least one control platform axis comprises a first control platform axis including a first horizontal wall, first parallel guides attached to the first horizontal wall, and a first movable carriage supported by the first parallel guides. In one embodiment, the first movable carriage is coupled to a first controllable carriage driving motor. In one embodiment, the at least one bending unit comprises a first bending unit attached to the first movable carriage. In another embodiment, the first bending unit comprises a first bending tool coupled to a first bending motor, the first bending tool including a first shank and a first head, and the first bending motor providing rotational motion to the first bending tool. In a further embodiments, the first head comprises two adjustable pins in a slot or fork configuration.

In some embodiments, the at least one control platform axis further comprises a second control platform axis including a second horizontal wall, second parallel guides attached to the second horizontal wall, and a second movable carriage supported by the second parallel guides. In one embodiment, the second movable carriage is coupled to a second controllable carriage driving motor. In one embodiment, the at least one bending unit comprises a second bending unit attached to the second movable carriage. In another embodiment, the second bending unit comprises a second bending tool coupled to a second bending motor, the second bending tool including a second shank and a second head, and the second bending motor providing rotational motion to the second bending tool. In a further embodiment, the second head comprises two adjustable pins in a slot or fork configuration. In one embodiment, the first movable carriage moves along the first parallel guides in a first direction and the second moveable carriage moves along the second parallel guides in a second direction, the first direction being different from the second direction.

Also provided herein, in some embodiments, is a method of bending a wire, the method including i) providing the apparatus of claim 1; ii) advancing a wire with the feeding system; iii) engaging the wire with the at least one bending unit; iv) bending the wire with the at least one bending unit; v) retracting the at least one bending unit; and optionally repeating steps ii-v to form a desired structure. In some embodiments, engaging the wire with the at least one bending unit comprises moving a movable carriage of the at least one control platform axis with a controllable carriage driving motor to position the wire between two adjustable pins on a bending unit attached to the movable carriage, the moving of the movable carriage being controlled by an algorithm.

Further features and advantages of the presently-disclosed subject matter will become evident to those of ordinary skill in the art after a study of the description, figures, and non-limiting examples in this document.

DESCRIPTION OF THE FIGURES

FIG. 12 shows algorithm 1.

FIG. 13 shows algorithm 2.

FIG. 14 shows algorithm 3.

FIG. 15 shows algorithm 4.

FIG. 21 shows comparison of the AMWB machine with other manufacturing processes.

FIGS. 22A-H show defect generated from traditional lattice manufacturing.

DETAILED DESCRIPTION OF THE INVENTION

Figure 1:
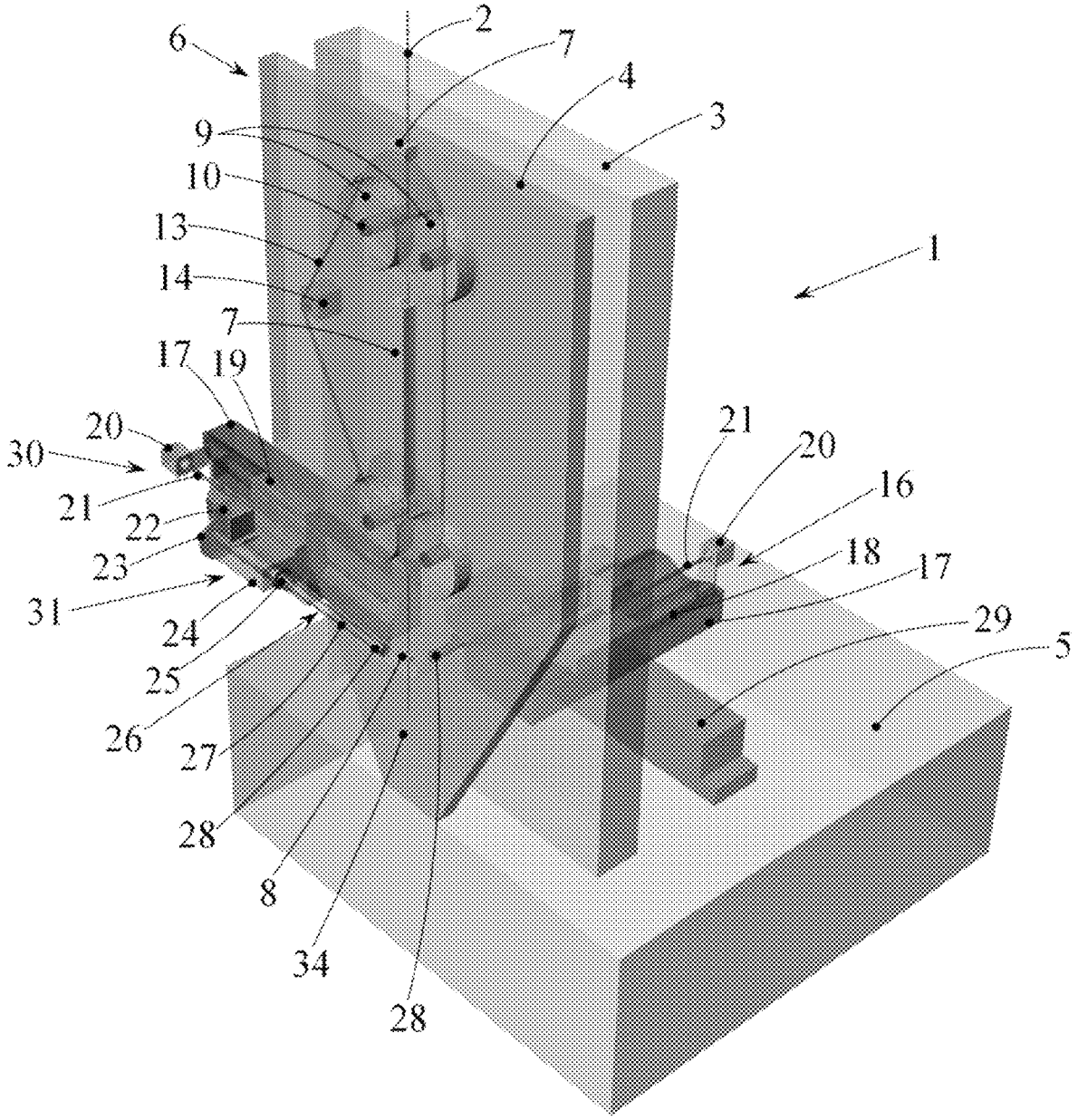
FIG. 1 shows a bending machine according to an embodiment of the present disclosure.

The present disclosure relates to a wire bending apparatus, which is referred to herein as an automatic metal wire bending (AMWB) machine and/or a metal wire lattice structure fabrication (WLSF) machine. Referring to FIG. 1, in some embodiments, the bending apparatus 1 is an apparatus for bending wire including a feeding system 6, at least one control platform axis, and at least one bending unit 31. In some embodiments, the bending apparatus includes a bottom plate 3, a top plate 4, and a base 5 supporting the bottom plate 3 and/or the top plate 4. The bottom plate 3, the top plate 4, and the base 5 are independently made from any suitable material, such as, but not limited to, steel, wood, polymer, or a combination thereof.

The feeding system 6 controls the feed rate and feed length of a wire 2 in a synchronous manner with the bending unit 31 according to a control algorithm (e.g., one or more of algorithms 1-4; FIGS. 12-15). The feed rate is selected and/or may be adjusted based upon on the desired speed of the bending process, while the feed length for each bending/folding action is calculated according to the size, scale, and bending pattern of the structure being formed. For example, in some embodiments, the feed length for each bending/folding action is determined by the feeding system 6 to provide a lattice structure with a desired size, scale, and pattern.

In some embodiments, the feeding system 6 includes at least one wire guide 7 and at least one feed roller pair on a front side of the top plate 4. For example, in some embodiments, the feeding system 6 includes at least one wire guide 7, a bending support 8, a first feed roller pair 9, and a second feed roller pair 12 on a front side of the top plate 4. In one embodiment, the first feed roller pair 9 pulls the wire from a spool in a consistent manner. In another embodiment, the second feed roller pair 12 pushes the wire through the wire guide 7 in a consistent manner toward a bending zone or spot 33 (FIG. 2), which is a region on the top plate 4 where the wire is bent by the bending unit 31. In a further embodiment, the first feed roller pair 9 and/or the second feed roller pair 12 includes a corrugated roller surface that reduces or eliminates slippage during the pulling/pushing of the wire. The wire guide(s) 7 placed on the top plate 4 protect the wire from deforming and help keep the wire aligned while feeding a continuous and consistent placement of wire to the bending spot 33. A bending support 8 mounted at the edge of the bending spot 33 is smaller in size than the wire guide 7, but provides similar support to the wire 2 while bending.

Figure 2:
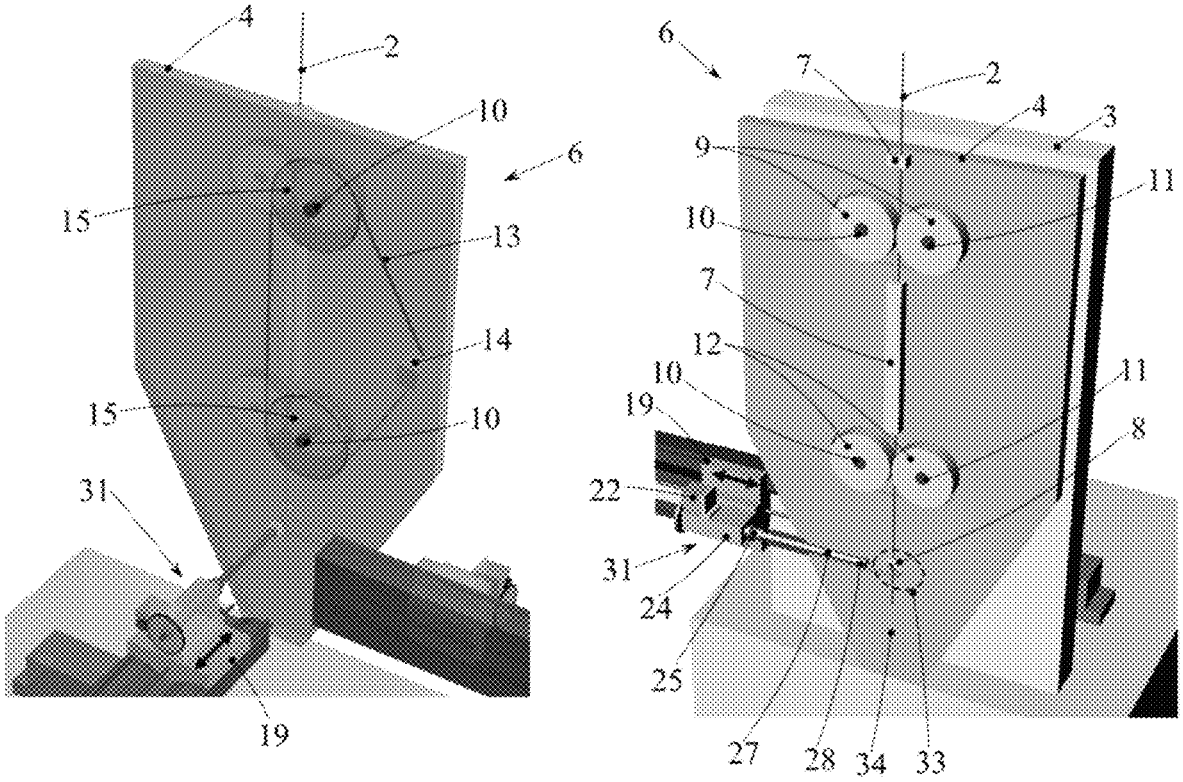
FIG. 2 shows a feed mechanism.

The feed roller pairs 9,12 are driven by any suitable article 15 or method. For example, in some embodiments, a feed roller from each of the feed roller pairs 9,12 is connected with a pulley (FIG. 2). In one embodiment, the pulleys are placed on the back side of the top plate 4, between the bottom plate 3 and the top plate 4. In another embodiment, one feed roller (primary roller) from each of the feed roller pairs 9,12 is connected with the pulley through a roller shaft 10, while the other feed roller (secondary roller) from each of the feed roller pairs 9,12 is connected to the top plate 4 through a roller pin 11. In a further embodiment, a belt 13 and a controllable feed motor 14 precisely drive the pulleys to rotate the primary roller and feed the wire 2. The controllable feed motor 14 includes any suitable motor for rotating the primary rollers, through the article 15, to consistently advance/feed the wire 2. Suitable controllable feed motors include, but are not limited to, a stepper motor (i.e., NEMA motor), a servo-closed loop-feedback motor, or a combination thereof. Unless stated otherwise, these components (e.g., roller shaft 10, roller pin 11, belt 13, motor 14, pulleys) are all considered part of the feed system 6.

Spacing between rollers in each of the feed roller pairs 9,12 can be adjusted to accommodate any suitable wire size and/or cross-sectional shape. Suitable wire sizes include, but are not limited to, between 35 gauge and 6 gauge. Suitable cross-sectional shapes of the wire include, but are not limited to, circular, triangular, rectangular, any other suitable cross-sectional shape, or a combination thereof. As will be appreciated by those skilled in the art, the present disclosure is not limited to the sizes and cross-sectional shapes above and may include any other suitable size and/or shape. Other articles 15 or methods for driving the feed roller pairs 9,12 include, but are not limited to, a gear or gears, a rack and pinion, or a combination thereof.

Additionally or alternatively, in some embodiments, the wire may be advanced by a claw or pincher device, a single rod, or a combination thereof. In one embodiment, where a single rod is used to advance the wire, the rod may be hard or flexible and could secure the wire against a lower friction surface so that movement of the rod and/or surface perpendicular to the other would advance the wire. Although any configuration or method may be used to advance the wire, as will be appreciated by those skilled in the art, some configurations/methods may be better suited to advance wire of certain sizes/cross-sectional shapes. For example, in one embodiment, the belt/pulley/roller configuration may be better suited to advance smaller gauge wire whereas the gear/roller configuration may be better suited to advance larger gauge wire and/or for a more precise bending location. Smaller gauge wire is usually wire that is smaller in diameter than about millimeters. In another embodiment, the length and rigidity/weight of the drive belt can be matched for the size and weight of the wire to be bent. The size, shape, and length of the belt can vary and will have an impact on the power, wire gauge and size of the machine.

In some embodiments, the at least one control platform axis includes a first control platform axis 16 and a second control platform axis 30. The first control platform axis 16 and the second control platform axis 30 are linear motion axes that form a control platform of the bending apparatus 1, and drive and control the bending unit 31 for three-dimensional (3D) bending. In some embodiments, such as a two-dimensional (2D) bending setup, the first control platform axis 16 bends the wire into planer pre-fabricated layers. In some embodiments, the addition of the second control platform axis 30 to the system provides 3D bending. The 3D bending provided by the first control platform axis 16 and the second control platform axis 30 permits and/or provides fully automated fabrication of 3D structures, such as, but not limited to, 3D wire lattices. The control axes are attached to the bending apparatus 1 through any suitable method. For example, in one embodiment, the first control platform axis 16 rests on a support 29 attached to the base 5. In another embodiment, the second control platform axis 30 is attached directly to the top plate 4.

In some embodiments, the construction of both control platform axes 16 and 30 is identical. For example, in one embodiment, each axis is provided with a horizontal wall 17 that supports the components thereof. In another embodiment, the horizontal wall 17 includes parallel guides 18 that support a movable carriage 19. In a further embodiment, each of the movable carriages 19 is driven by any suitable article and/or device. For example, in some embodiments, at least one of the movable carriages 19 is driven by a ball screw 21, which is attached to a controllable carriage driving motor 20. The direction along which the movable carriage 19 moves is dependent upon the orientation of the first control platform axis 16 or the second control platform axis 30 that the moveable carriage 19 is attached to. For example, in one embodiment, the carriages 19 on the first control platform axis 16 and second control platform axis 30 move along the directions represented by the double arrows shown in FIG. 2.

Although described herein primarily with regard to the first control platform axis 16 and the second control platform axis 30, the disclosure is not so limited and may include any other suitable configuration and/or number of axes. For example, in some embodiments, such as those involving 2-dimensional, 2.5-dimensional, and 3-dimensional bending, one to four control platform axes/heads may be placed orthogonal to each other and perpendicular to the wire feed direction i.e., left, right, front, and back side of the wire feeding direction. Alternatively, a single head that is rotated 360 degrees with a rotary carriage and a circular motion guide may be used to provide a 3-dimensional wire structure.

Each control platform axis and/or control head includes a separate bending unit 31. For example, in some embodiments, each movable carriage 19 holds a separate bending unit 31. In such embodiments, the movable carriage 19 is moved by the carriage driving motor 20 to place the bending unit 31 in position for proper bending according to a control algorithm (e.g., one or more of algorithms 1-4; FIGS. 12-15). In some embodiments, each bending unit 31 includes a bending tool 26. The bending tool 26 is coupled to a bending motor 22 through a bending gear 23. The bending motor 22 provides rotational motion to the bending tool 26 according to a control algorithm (e.g., one or more of algorithms 1-4; FIGS. 12-15).

Figure 3:
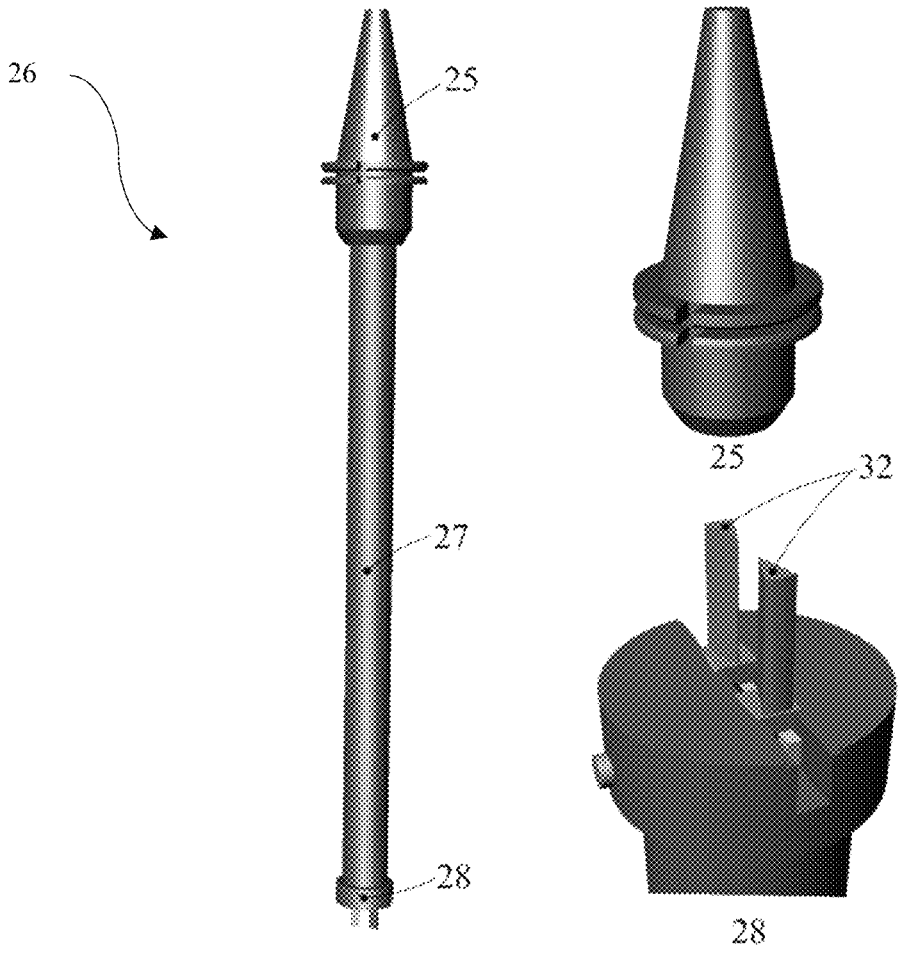
FIG. 3 shows a bending tool holder and tool.
Figure 4:
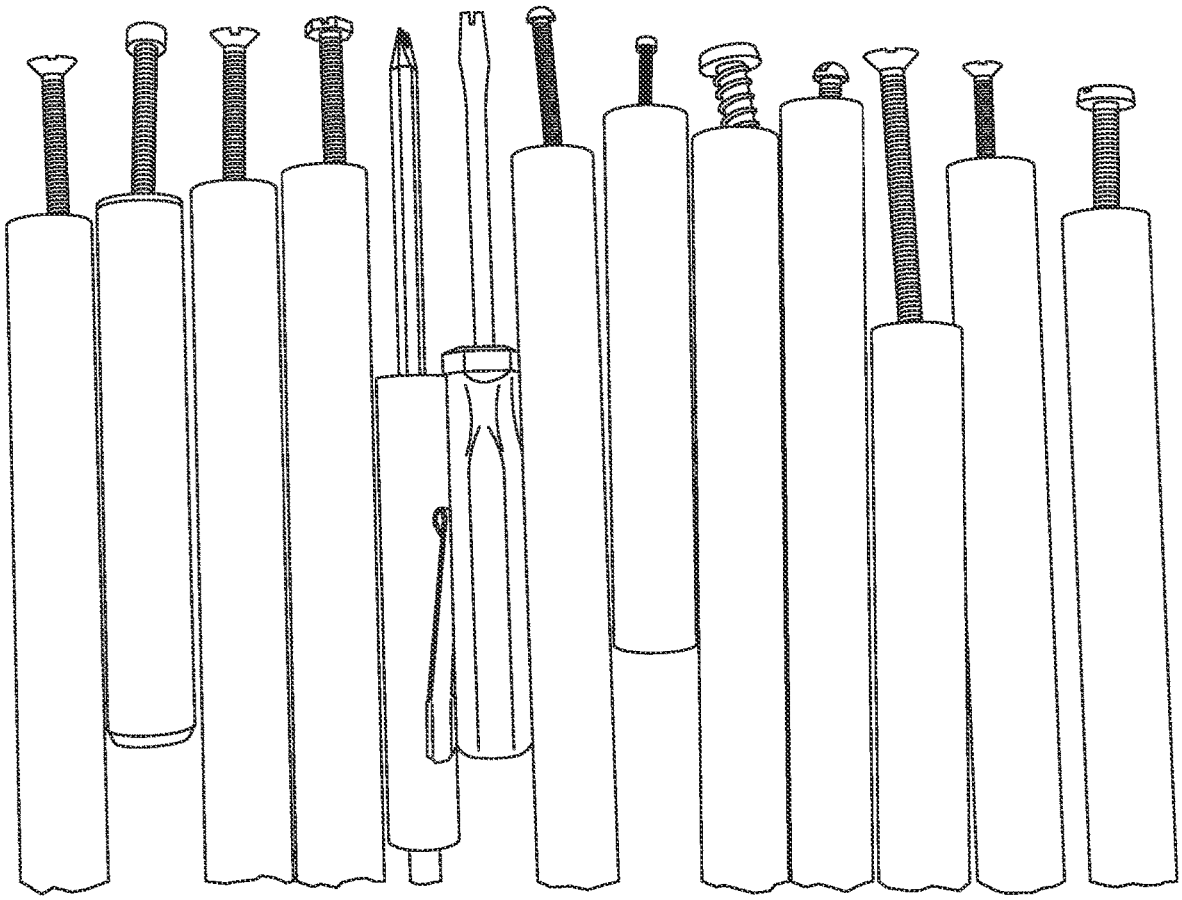
FIG. 4 shows various tools for the AMWB machine.
Figure 5:
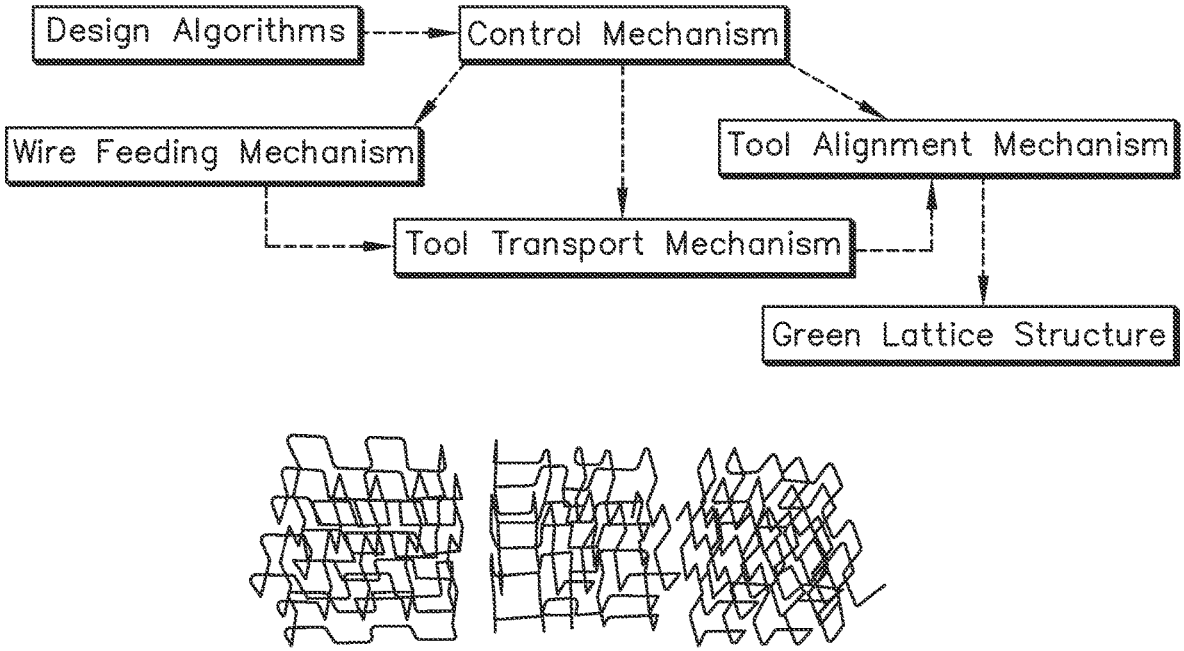
FIG. 5 shows AMWB machine schematics.

As illustrated in FIGS. 3-4, in some embodiments, the bending tool 26 consists of a shank 27 and a head 28. The shank 27 goes into a tool holder 25 and is secured by any suitable method, such as with a lock screw. In some embodiments, the tool holder 25 is optionally held by a bending tool post 25, which grips the tool holder 25 to reduce or eliminate slippage during rotation by the bending motor 22. The tool head 28 includes any suitable shape or configuration for bending the wire. For example, in one embodiment, the head 28 has a slot or fork configuration (FIG. 3). In another embodiment, the slot or fork configuration is provided by two adjustable pins 32 which perform the bending operation on the wire 2 placed in between them. In a further embodiment, the size, cross-section, and spacing of the pins 32 vary depending on the wire gage and shape, and bending angle.

Additionally or alternatively, one or both sides of the head can be independently adapted for the type of bend that is desired. Such customized heads can be interchangeable so that the bending of a single linear stretch of wire can contain multiple types of bend. For example, one or both sides of the head can be triangular, square, or rounded so that the bend is a sharp angled bend or a rounded arc shaped bend. The angle in a triangular head can be from 5 degree to 180 degree in range. The shape of the bend might vary depending on the stress requirements of a particular bend or the location of a particular bend in the 3-dimensional structure.

Also provided herein is a method of bending a wire (FIGS. 5-8). In some embodiments, the method includes (i) advancing a section of wire with the feeding system 6, (ii) bending the wire through a bending cycle, and (iii) optionally repeating steps (i) and (ii) as many times as desired to form a shape. In one embodiment, after the wire is fed with a required length calculated from the lattice design and dimension, the bending cycle includes moving the bending tool 26 of the appropriate control platform axis from a rest position to the wire, engaging the wire and the tool head 28 (e.g., positioning the wire between the bending tips 32 of the tool head 28), twisting the bending tool 26 with a bending motor 22, and retracting and rotating the bending tool 26 back to the rest position. The rotating of the bending tool 26 when the tool head 28 and the wire are engaged bends the wire through a specified angle. In some embodiments, as the bending cycle proceeds, the bent wire rests on a buffer area 34 as work in progress. The power of the controllable feed motor can be adjusted and adapted for any size wire or a gear system can be used to amplify the power of the motor.

The apparatus and method disclosed herein may be used to bend any suitable wire. Suitable wire includes any material that is amenable to bending, may be solid or hollow (e.g., a pipe), and includes any suitable cross-sectional shape (e.g., circular, triangular, square, or other cross section shape). In some embodiments, the wire is a metal or alloy containing metal such as, but not limited to, Stainless Steels such as AISI 304, 304L, 310, 310S, 316, 316L, 405, 408, 410, and 416; Low Carbon Steels such as AISI 1006 1008, 1010, 1015, 1018, 1020, 1022, and 1025; Nichrome 60 and 80; pure Titanium and medical grade Titanium alloy such as Ti-6Al-4V; Aluminum alloys such 1100, 3003, 5052, 6061, and 6063; pure Copper and Copper alloys such as C21000, C27000, C83600, C83400, C84400, and C84500; and Tungsten. Additionally or alternatively, in some embodiments, the wire includes composites, polymers, plastics, or a combination thereof.

Further provided herein are compositions and methods for joining metallic structures. In some embodiments, the composition includes an interlayer alloy suspension. In some embodiments, the interlayer alloy suspension includes a composition comprising a polymer binder, an organic solvent, and a metal alloy powder.

The polymer binder includes any suitable polymer binder for forming an adhesive solution with the organic solvent. In some embodiments, the polymer binder is an acrylic or acrylate ester based polymer. Suitable acrylic or acrylate ester based polymers include, but are not limited to, Poly (methyl 2-cyanoacrylate) (MCA), Poly(ethyl 2-cyanoacrylate) (ECA), Poly(methyl methacrylate) (PMMA), Poly (methacrylate) (PMA), Poly(ethyl acrylate), and ethylene-ethyl acrylate copolymers, Poly(n-butyl-methacrylate) (Poly (n-BMA)), Poly(2-ethylhexyl acrylate) (P2EHA), Poly(isobutyl methacrylate) Poly(i-BMA), Poly(cyclohexyl methacrylate) (PCHMA), Poly(2-hydroxyethyl methacrylate) Poly(2-HEMA), and Poly(2-ethylhexyl methacrylate) PEHMA. These polymers are sometimes characterized by their average molecular weight (MW). For example, the average MW of PMMA may range from 15,000 to 550,000.

The overall acrylic or acrylate ester based polymers are hydrophobic and do not dissolve in highly polar solvents like water. Due to the presence of a large non-polar hydrocarbon backbone in the polymers, the polar portion of the polymer is not readily accessible for the highly polar solvents resulting in low solubility in such solvents. Thus, solubility of these polymers is governed by the "like-dissolve-like" phenomena of organic solute-solvent. Accordingly, in some embodiments, suitable organic solvents with higher vapor pressure (>25 mmHg at 20° C.) include, but are not limited to, ether based solvents such as Tetrahydrofuran, 1,2-Dioxolane, 1,3-Dioxolane, and 1,4,-Dioxane; chlorinated hydrocarbons such as Chloroform and Trichloroethylene; ketone based solvents such as Acetone; and ester based solvents such as Ethyl acetate.

The metal alloy powder includes any metal alloy powder suitable for forming the inter-layer material for transient liquid phase (TLP) bonding or otherwise bonding metallic structures. Transient liquid phase (TLP) bonding, also known as diffusion brazing is an attractive flux-less, high strength joining technique for its relatively low pressure requirement and can join a range of base metals (i.e. Al alloys, carbon steels, stainless steels, Ni alloys, and Ti alloys). An interlayer alloy is generally applied as coating between the flat and closely pact joining surfaces in the form of thin foil, powders, paste, electroplate, sputter etc. The material from interlayer alloy diffuses into the base metal and seal the bond through isothermal solidification which happens below the solidus temperature of the base metal. For example, in some embodiments, the metal alloy powder includes, but is not limited to, Nickel, Iron, or Copper based alloy powders containing melting-point depressants (MDP) such as, but not limited to, Boron, Silicon, Phosphorus, Gallium, Aluminum, Copper, Silver, Zinc, and Tin. These MDPs help make the transient liquid phase at the inter-nodal area and facilitate diffusion at the nodes of wire structures.

Figure 23:
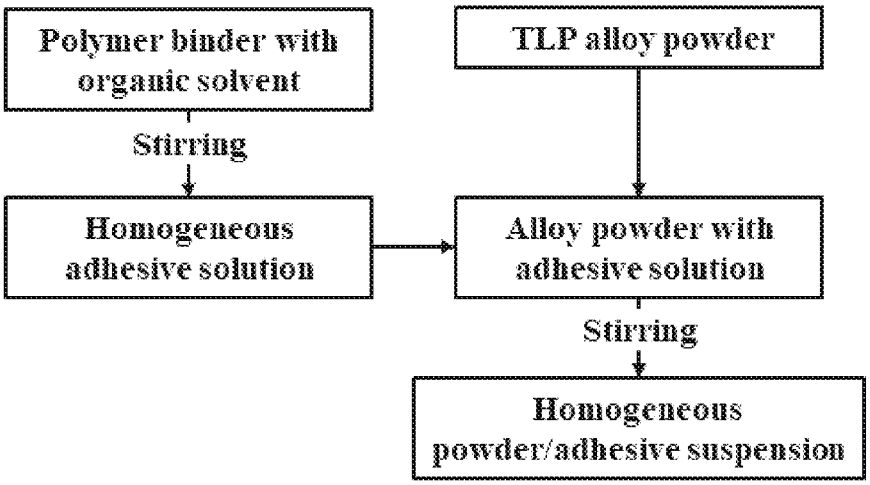
FIG. 23 shows the interlayer suspension preparation processes.

Referring to FIG. 23, in some embodiments, the polymer binder and the organic solvent are mixed together first to form a homogeneous adhesive solution. Once the homogeneous adhesive solution is prepared, the metal alloy powder prepared as the inter-layer material for TLP bonding is thoroughly mixed with the adhesive solution. The mixing may be performed by any suitable method such as, but not limited to, stirring with a magnetic stirrer between 10-60 minutes. The resulting interlayer alloy suspension may then be used to join metallic structures.

The structures formed herein, such as a semi-entangled green complex 3D architecture, can be dipped in the interlayer alloy suspensions disclosed herein to 1) generate an interlayer alloy coat on angular wall with enough solid loading for TLP bonding; 2) reach hard to reach places in the complex multi-scale structure; 3) bridge wide gap (>150 nm) by forming liquid bridge with enough solid loading for TLP bonding; and 4) provide enough solid loading for TLP bonding on any types of surface (i.e. flat, cylinder) with high aspect ratio. Without wishing to be bound by theory, it is believed that the existing form of the alloy material is not suitable for wide gap (>100 nm) joining, and that this is the first interlayer alloy that is applicable to complex structure with hard to reach places. This is also believed to be the first form of interlayer alloy that considers curved and wire shape surface rather than flat surface.

Figure 24A:
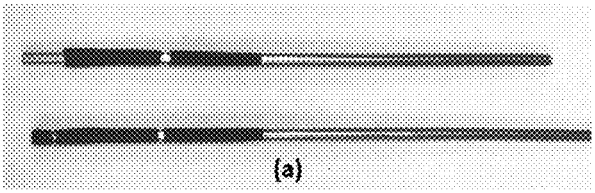
FIGS. 24A-C show coated wire after dipping in the interlayer suspension and their measure thickness in various segment.
Figure 24B:
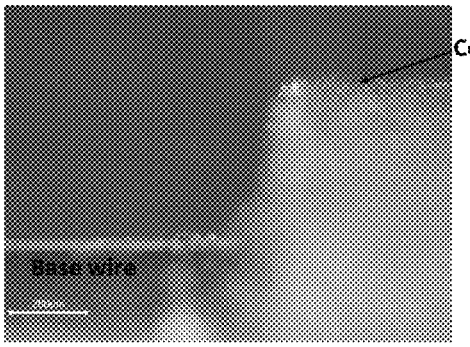
Figure 24C:
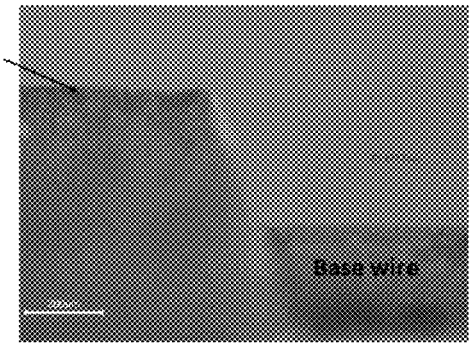
Figure 25A:
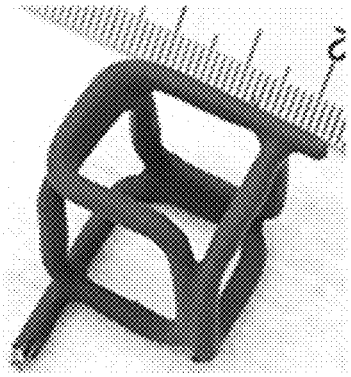
FIGS. 25A-F show multi-scale green lattice structures after coating and TLP bonded. (A-B) Show 8 mm C1006 (A) after coating and (B) TLP bonded. (C-D) Show 8 mm 2×2×1 C1006 (C) after coating and (D) TLP bonded. (E-F) Show 8 mm 2×2×2 C1006 (E) after coating and (F) TLP bonded.
Figure 25B:
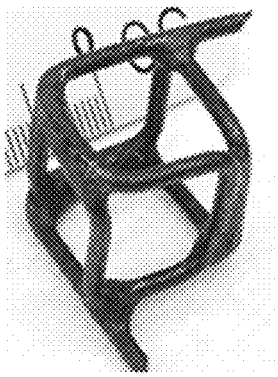
Figure 25C:
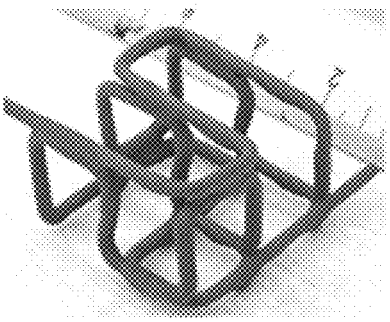
Figure 25D:
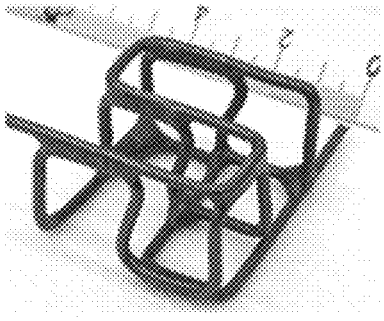
Figure 25E:
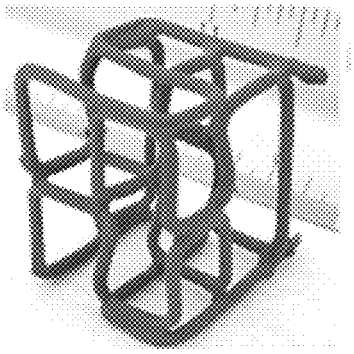
Figure 25F:
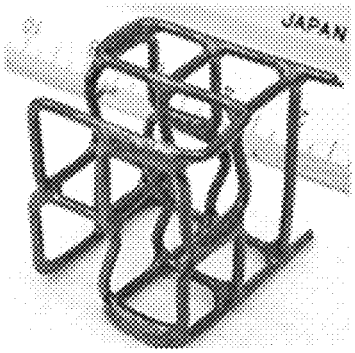
Figure 26:
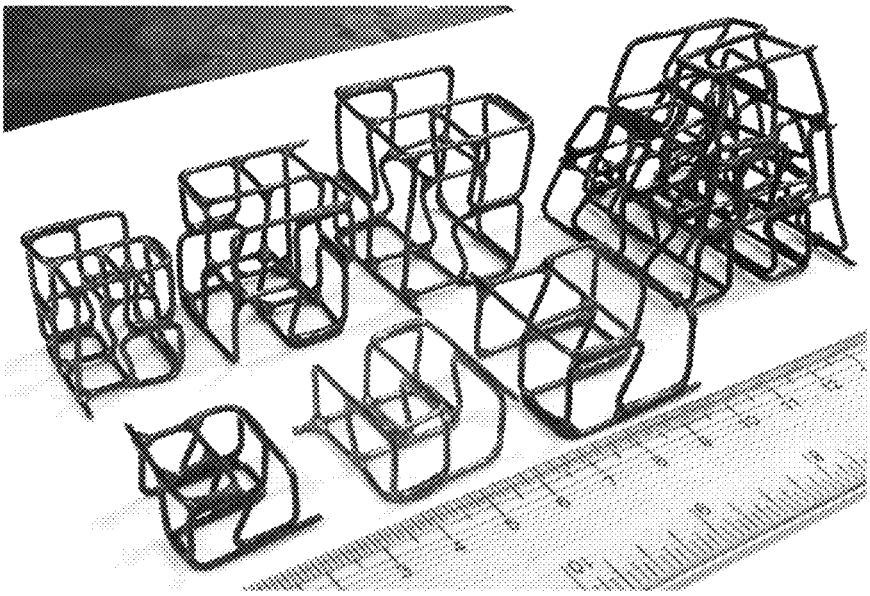
FIG. 26 shows a set of multi-scale lattice structure bended with AMWB, coated with optimized interlayer suspension and bonded with TLP process.

Accordingly, in some embodiments, joining metallic structures using the interlayer alloy suspension includes first immersing the metallic structure(s) in and then removing the metallic structure(s) from the interlayer alloy suspension. Due to the higher vapor pressure of the organic solvent, it completely evaporates when the structure is removed from the suspension, leaving a coat of powder and polymer binder with thickness at different places (FIGS. 24A-C). The coated structures are arranged as desired and placed in a vacuum (10 mTor to 200 mTor) furnace with the temperature raised between 700° C. to 1500° C. at a rate of 5-50° C./min. When the polymer binder volatilizes, the TLP alloy powders are sintered and adhere to the surface of the metal structures. Since the polymer binder volatilizes at high temperature and leaves no residue in the vacuum furnace, it does not impair the bond quality. Green lattice structures of different size after coating and TLP bonded are shown in FIGS. 25A-F. Various joined structures are shown in FIG. 26.

The apparatus and methods disclosed herein are useful for bending a linear material rapidly, in multiple axes, in multiple and diverse configurations, and with any size diameter linear material. This results in three dimensional structures most often configured as lattices, scaffolds, or frameworks. For example, the bending apparatus is capable of forming different types of unit lattice including, but not limited to, cuboid, pyramidal, hexagon, truss like, prismatic, BCC, FCC, and any other suitable shape or configuration. Additionally, these structures may form a super structure, including a cube (with square and/or rectangle sides), pyramid, dome, cylinder, etc. using the combination of unit lattice.

In some embodiments, the resulting lattices, scaffolds, or frameworks are covered or coated with a variety of materials to make a 3-dimensional solid appearing object. Such objects may be lightweight and/or very durable depending on the desired characteristics of the object. These structures are also have multiple functionality, making them diverse and easy to manufacture. Another benefit of these structures is that they are made with continuous wire. The wire is reusable, recyclable and the part can be easily modifiable making it a sustainable and green manufacturing process. For example, everything from micro drones (artificial insects) to dwelling/storage units can be made using the apparatus and methods disclosed herein. Other uses include aircraft components such as fuselage and wings, automobile components such as doors, dashboards, etc., boat hulls and components, and many other structures. A further advantage of such large structures, such as dwellings/storage units, is that the wire components and the covering materials can be delivered separately and assembled on site, such as the site of a natural disaster or military outpost. This would make delivery easier and more efficient than the finished structures. Small structures such as the artificial insects mentioned could use small fiber wires (the size of a human hair or less) and covered by ultra-thin polymer or composite films for weight conservation and fuel efficiency.

Furthermore, unlike the existing articles and methods, the apparatus and methods disclosed herein provide a continuous metal wire bending process to make a 3D structure; have a less complicated roller feed mechanism; have an adjustable bending tip to introduce different bending diameters; have bending heads that are easily interchangeable and can handle a wide range of wire gauge as well as wire materials; have a bending radius that is sharp compared to existing roller-die bending mechanism; have a wire diameter that is not restricted for a rigid 3D structure; and have a machine control mechanism suitable for this machine that is developed to synchronize the automation and make valid 3D functional structure. Accordingly, the apparatus disclosed herein may bend continuously fed metal wire following the multi-layer, periodic or non-periodic lattice architecture, to construct an organized but loose (semi-entangled) wire-shaped (green) object. This structure is referred to herein as a 'green lattice' structure. This green object demonstrates the shape of the final product and may be joined with its node to provide a mechanically strong functional product. For example, a novel joining solution (inter-layer ink) is disclosed to join the nodes from the loosen (green) structure by dipping process followed by vacuum heating.

The details of one or more embodiments of the presently disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

When the term "including" or "including, but not limited to" is used, there may be other non-enumerated members of a list that would be suitable for the making, using or sale of any embodiment of this invention.

While the terms used herein are believed to be well understood by those of ordinary skill in the art, certain definitions are set forth to facilitate explanation of the presently-disclosed subject matter.

Unless defined otherwise, all technical and scientific terms used herein have the same meaning as is commonly understood by one of skill in the art to which the invention(s) belong.

All patents, patent applications, published applications and publications, GenBank sequences, databases, websites and other published materials referred to throughout the entire disclosure herein, unless noted otherwise, are incorporated by reference in their entirety.

Although any methods, devices, and materials similar or equivalent to those described herein can be used in the practice or testing of the presently-disclosed subject matter, representative methods, devices, and materials are described herein.

The present application can "comprise" (open ended) or "consist essentially of" the components of the present invention as well as other ingredients or elements described herein. As used herein, "comprising" is open ended and means the elements recited, or their equivalent in structure or function, plus any other element or elements which are not recited. The terms "having" and "including" are also to be construed as open ended unless the context suggests otherwise.

Following long-standing patent law convention, the terms "a", "an", and "the" refer to "one or more" when used in this application, including the claims. Thus, for example, reference to "a cell" includes a plurality of such cells, and so forth.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, "optional" or "optionally" means that the subsequently described event or circumstance does or does not occur and that the description includes instances where said event or circumstance occurs and instances where it does not. For example, an optionally variant portion means that the portion is variant or non-variant.

EXAMPLES

Example 1: Wire Feeding System

The feeding system is driven by a controllable motor 14 that controls the feed rate and feed length which are synchronized with the bending system. The feeding mechanism includes of two pair of rollers placed in series to feed the wire (FIG. 2). The roller pairs, which are connected with the feed motor 14 through a belt, rotate and feed the wire into the bending system at a specified feed rate. The feed rate depends on the desired speed of bending process. Feed length for each bending/folding action is calculated according to the size, scale, and bending pattern of the lattice structure. Rollers with adjustable spacing can accommodate any wire size preferable from 35 to 6 gage and any cross section such as circular, semi-circular, oval, hexagon, and rectangular.

Example 2: Bending Unit

A bending tool 26 is mounted on each bending control axis, which controls the engaging, retraction, and twisting motion of the tool. In a bending cycle, the wire is fed with a required length calculated from the lattice design and dimension. Then the bending tool of the appropriate bending axis moves from its rest position to the wire and engages the wire into the bending tips 32 of the tool head. The twisting motion of the bending tool given by the bending motor 22 causes bending the wire through a specified angle. Finally, the bending tool rotates back and is retracted to the rest position. The spacing between the bending tips are dependent on the wire gauge. The size and cross-sectional shape of the bending tips are selected based on the wire shape and bending angle.

Example 3: Control Platform

The control platform includes instructions to automate the wire feeding and the location and direction of the wire bending. FIGS. 9-15 demonstrate the algorithms and architecture of the instructions. The instructions control the 2-dimensional, 2.5 dimensional, and the 3-dimensional bending of the wire.

Example 4: Production of a Two Dimensional Object

Figure 6:
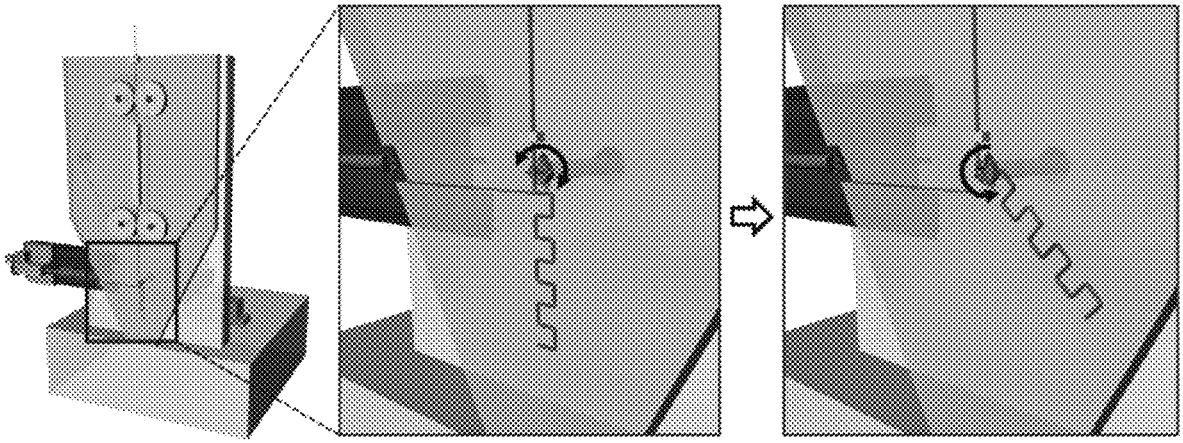
FIG. 6 shows the bending component pieces and how it is contacted with the wire.

A straight linear wire is bent into a "kinked" planar structure using a single bending head to get a 2 dimensional structure as depicted in FIG. 6.

Example 5: Production of a Three Dimensional Object

Figure 7:
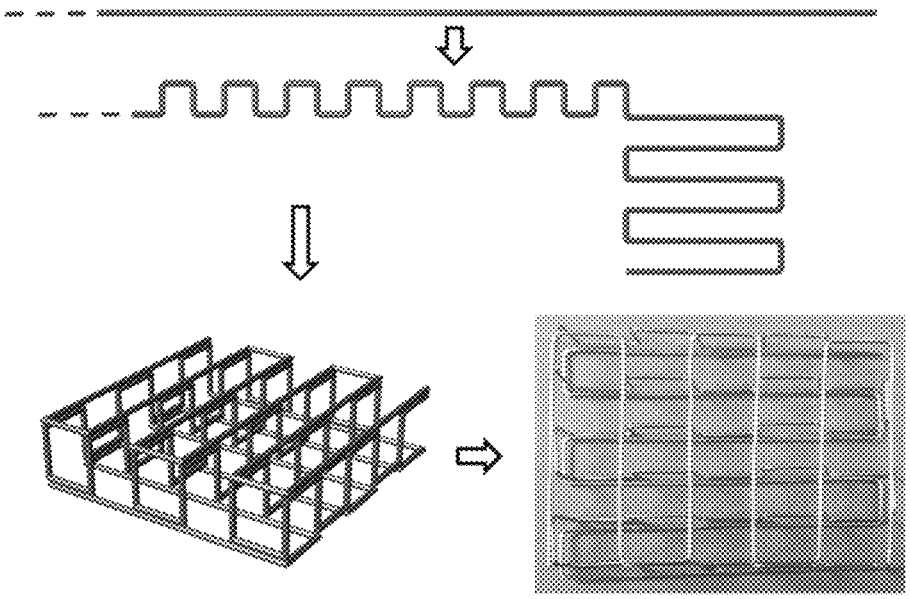
FIG. 7 shows 2-Dimensional structures after bending in one plane.
Figure 8:
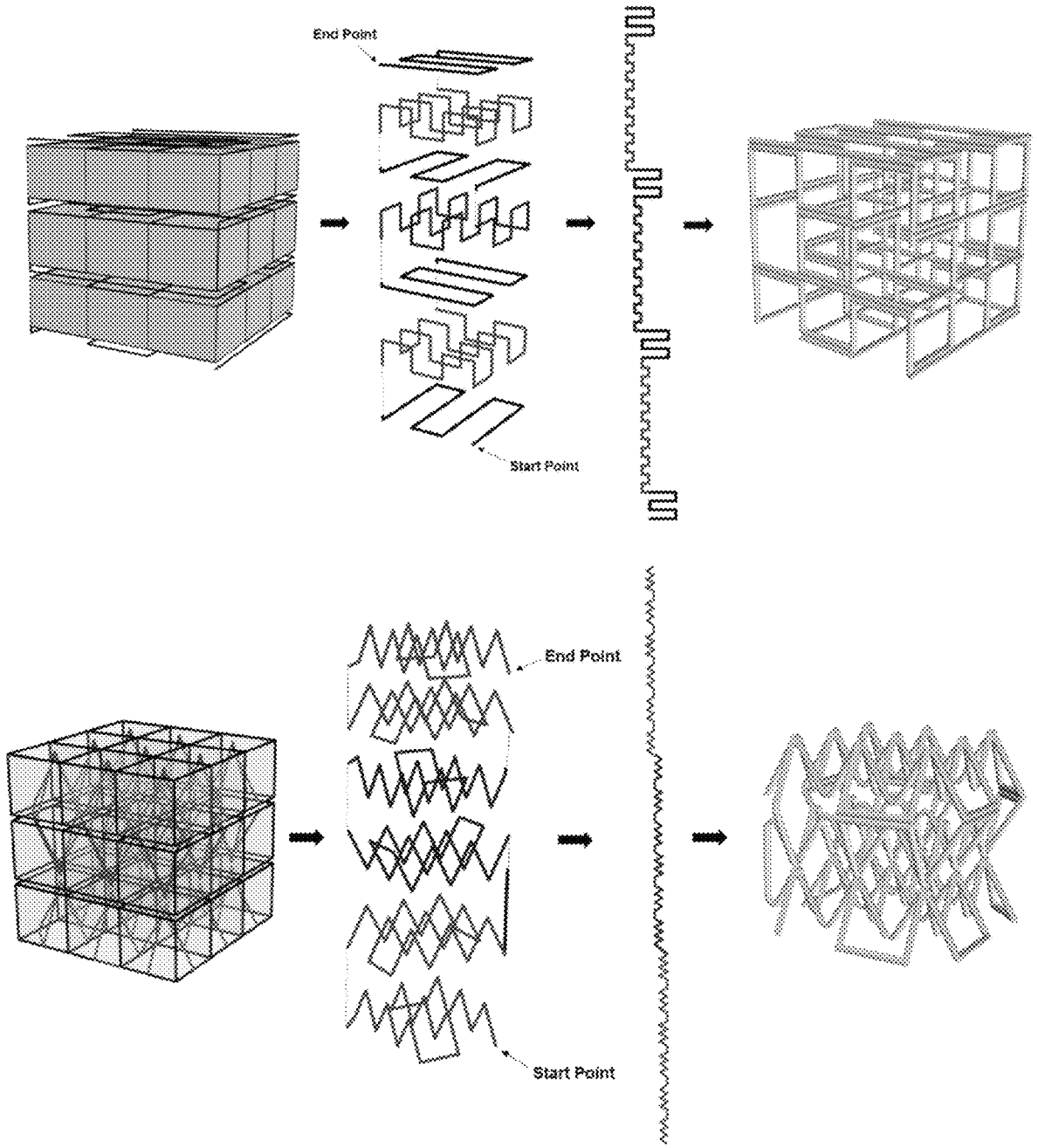
FIG. 8 shows 3-Dimensional structures After Bending in Multiple Planes.
Figure 9:
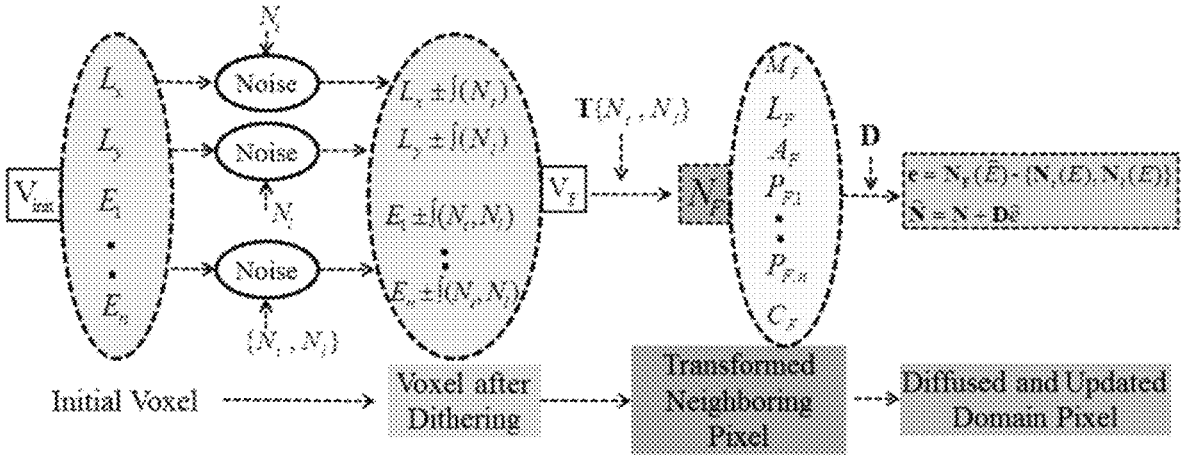
FIG. 9 shows the design algorithm for the AMWB machine.
Figure 10:
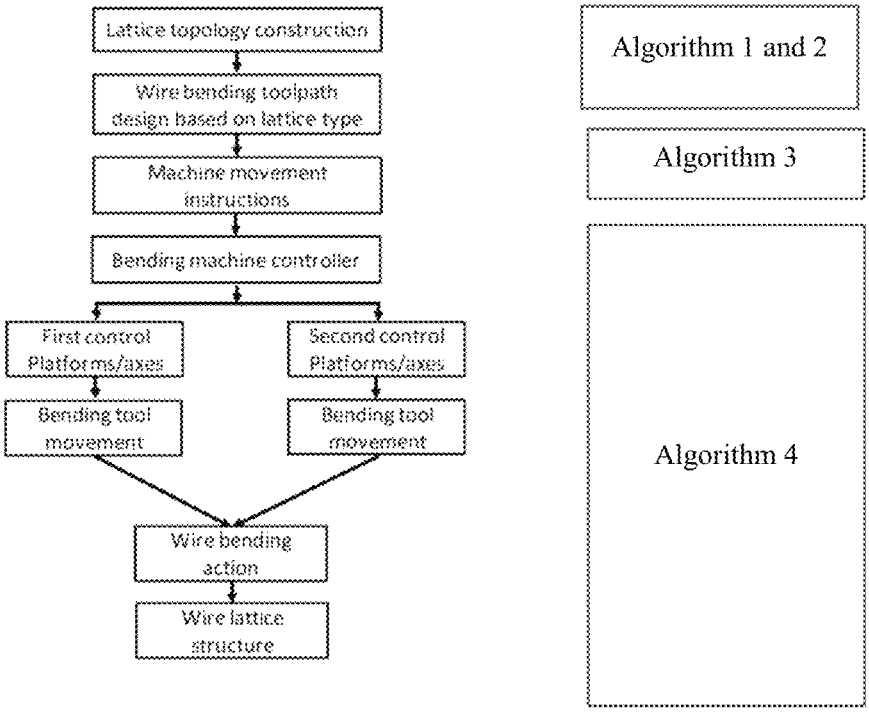
FIG. 10 shows a complete algorithm for 3-dimensional structure production.
Figure 11:
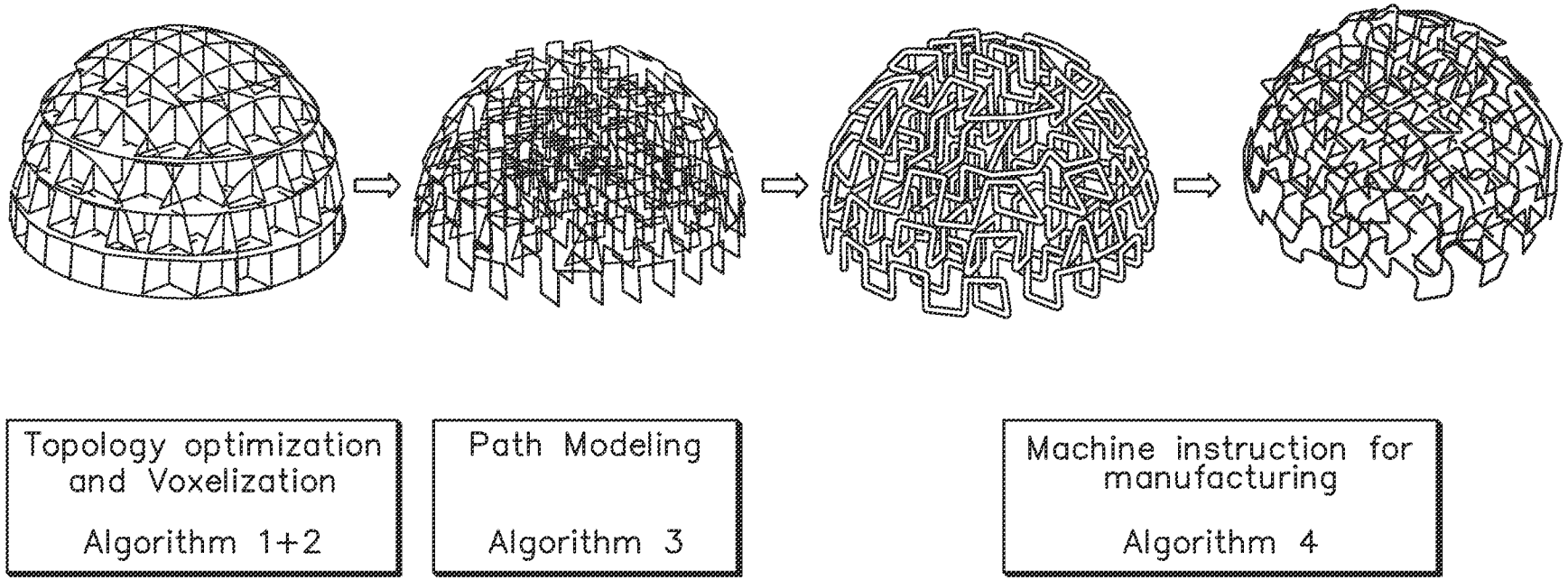
FIG. 11 shows the flow of algorithms for 3-dimensional structure production and the location of the application of algorithms 1-4 shown in FIGS. 12-15.

A "kinked" planar structure of Example 4 is bent into a 3D structure such as a dome, pyramid, etc. with multiple heads (up to four) or a single head that is rotated 360 degrees with a rotary carriage and a circular motion guide to get a 3-dimensional structure as depicted in FIG. 8. This is accomplished by first bending the 2-dimensional structure of Example 4 in a 2.5 dimensional structure as depicted in FIG. 7. This is accomplished using multiple heads, usually two heads, or a single head that can rotate 90 degrees. The 2.5-dimensional structure is then bent into the 3-dimensional structure as depicted in FIG. 8 by using multiple heads (up to four) or a single head that is rotated 360 degrees with a rotary carriage and a circular motion guide.

Figure 16:
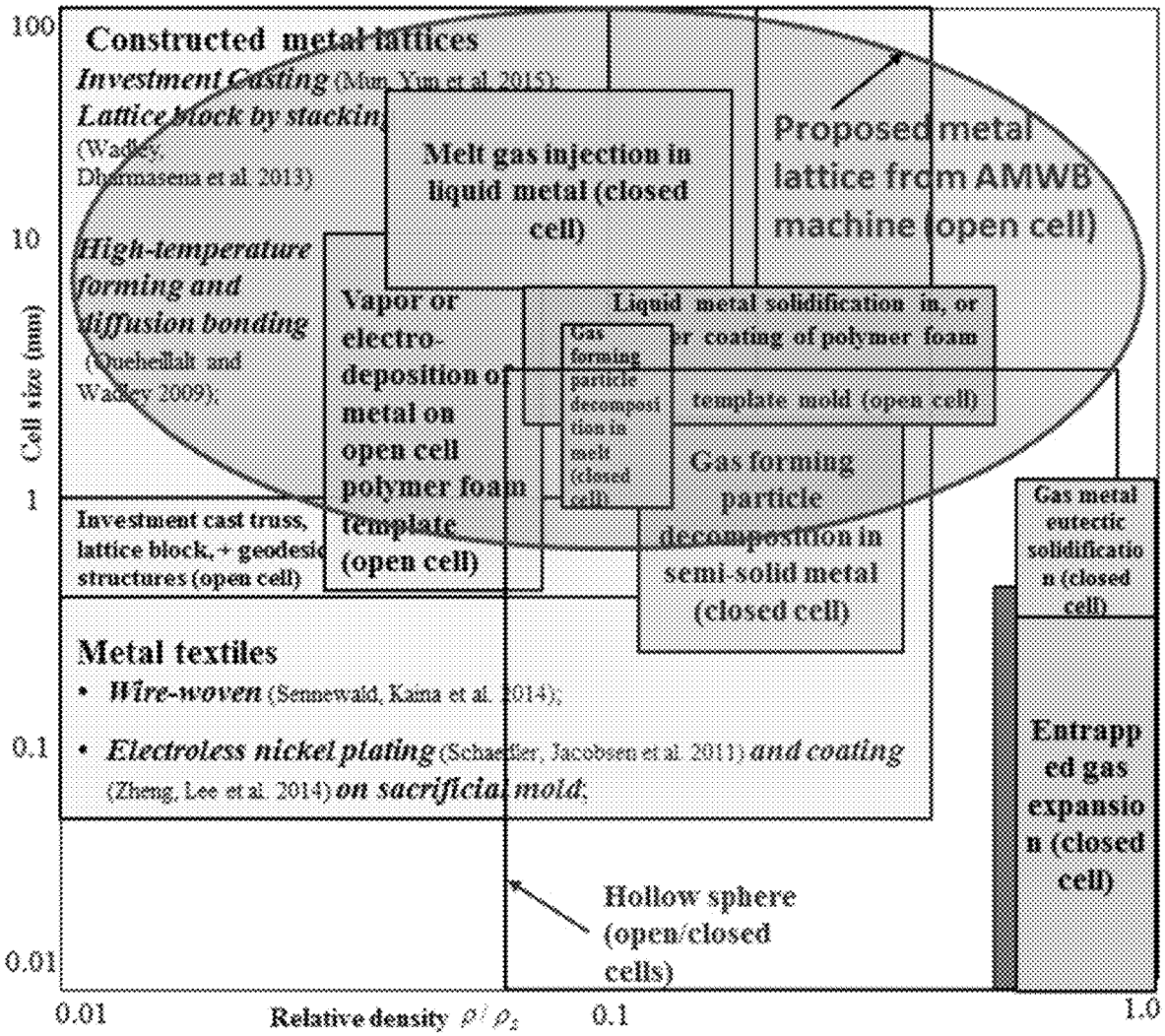
FIG. 16 shows achievable lattice structure size with the AMWB machine. The references noted in the Figure are reproduced as references 1-6 in the References section contained herein.
Figure 17:
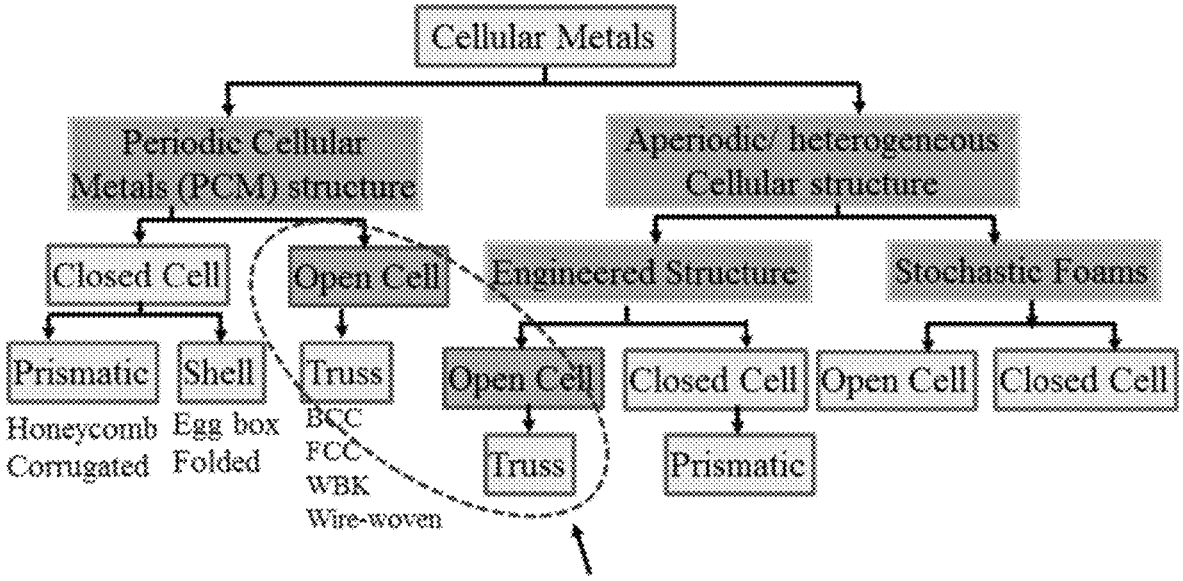
FIG. 17 shows the scope of the AMWB machine disclosed herein.
Figure 18A:
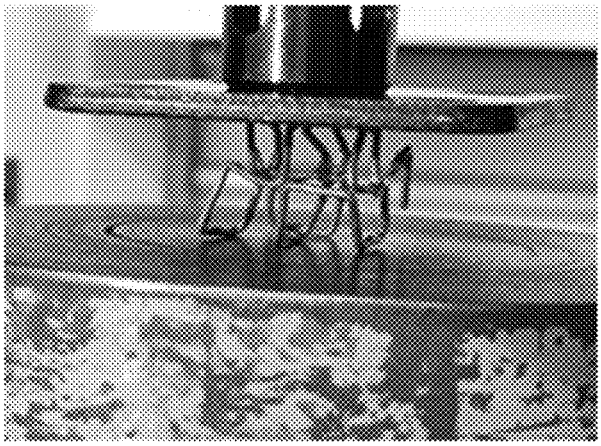
FIGS. 18A-C show mechanical testing results of lattice structure manufactured with AMWB machine. (A) Shows a 2×2×2 structure made from copper and epoxy with a diameter of 1.02 mm, a volume fraction of 4.2%, and $\sigma$ of 0.98 MPa. (B) Shows a 2×2×1 structure made from carbon steel and epoxy with a diameter of 1.63 mm, a volume fraction of 6.2%, and $\sigma$ of 0.83 MPa. (B) Shows a 2×2×2 structure made from carbon steel and epoxy with a diameter of 1.63 mm, a volume fraction of 6.2%, and $\sigma$ of 0.64 MPa.
Figure 18B:
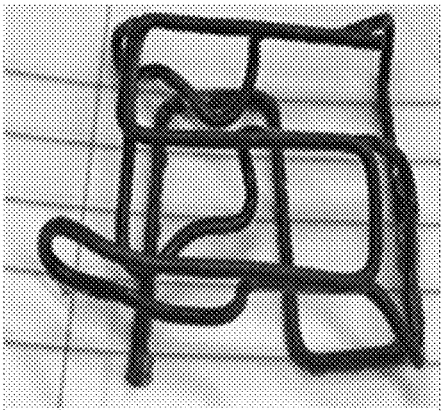
Figure 18C:
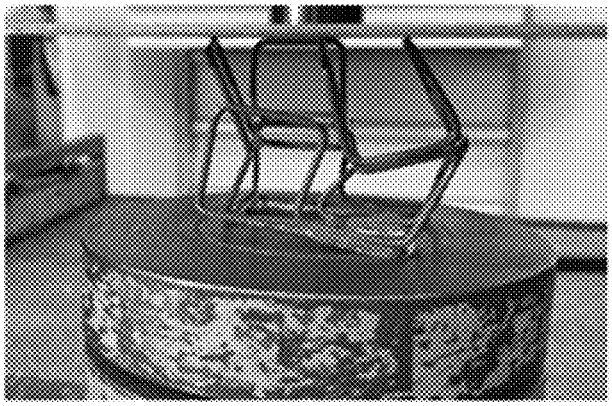
Figure 19A:
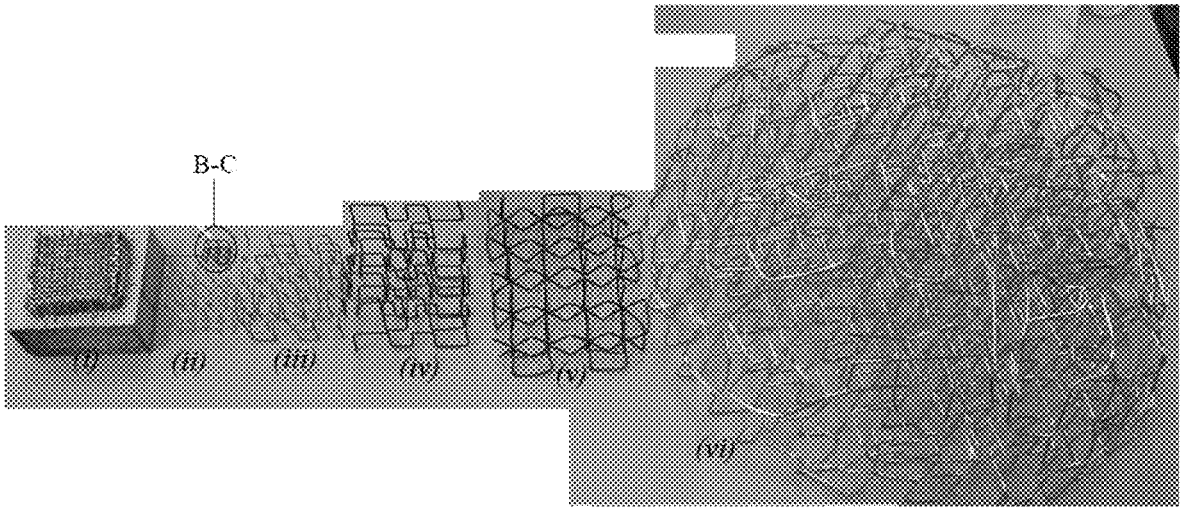
FIGS. 19A-F show multi-scale and multi-layer lattice structure manufactured with different wire material and gauge using the AMWB machine. (A) Shows structures i-vi. (B) Shows an applied load of 3 pounds on the structure identified in (A). (C) Shows an applied load of 13 pounds on the structure identified in (A). (D) Shows an alternate view of structure iv and v. (E) Shows an applied load of 141 pounds on one of the structures. (F) Shows an applied load of 60 pounds on one of the structures.
Figure 19B:
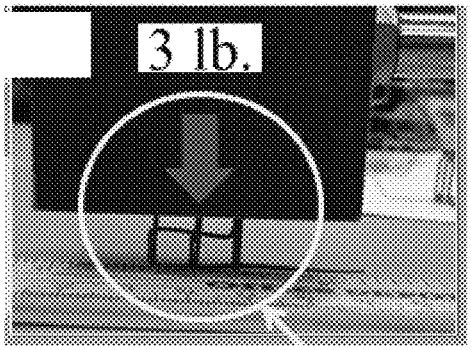
Figure 19C:
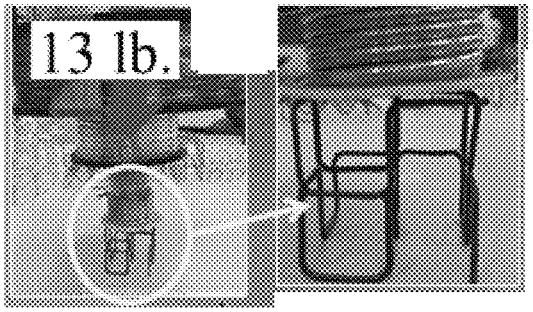
Figure 19D:
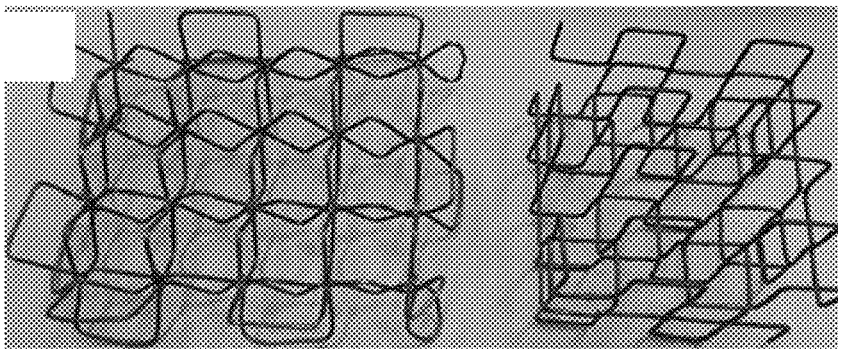
Figure 19E:
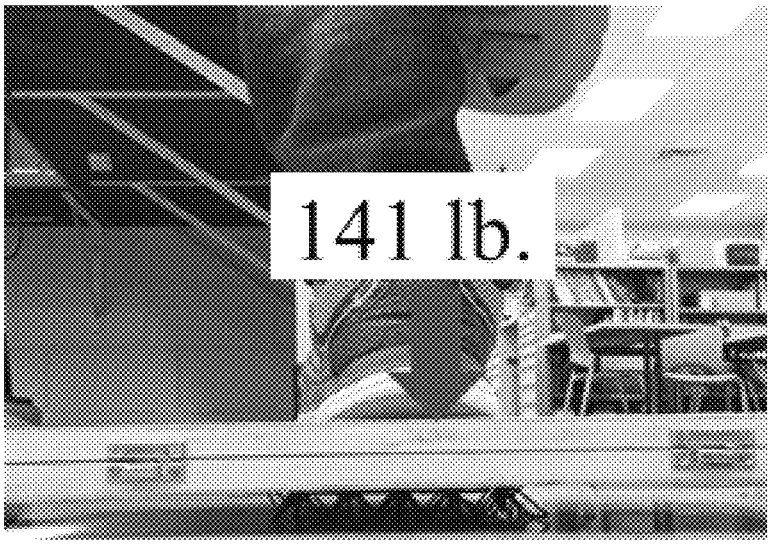
Figure 19F:
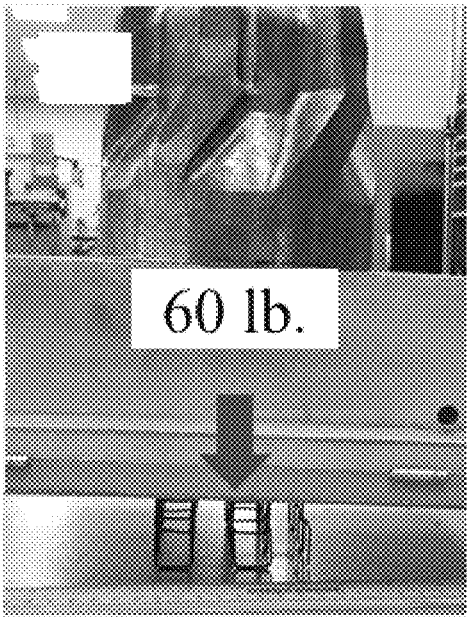
Figure 20:
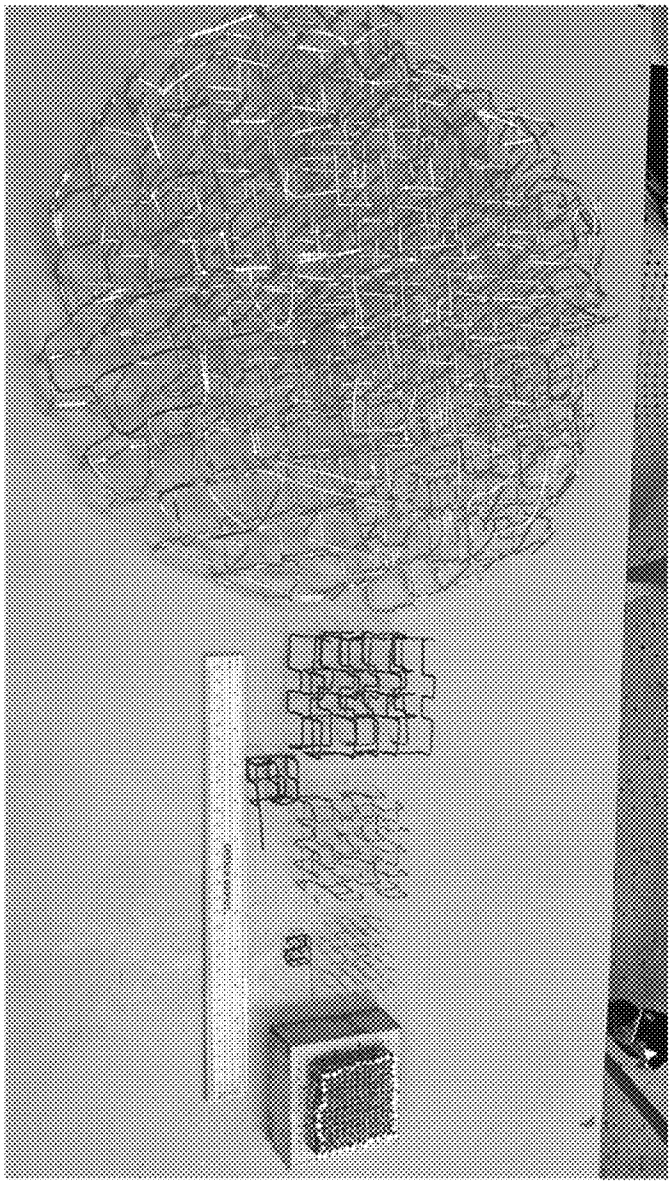
FIG. 20 shows multi-scale lattice structure manufactured with the AMWB machine.
Figure 22A:
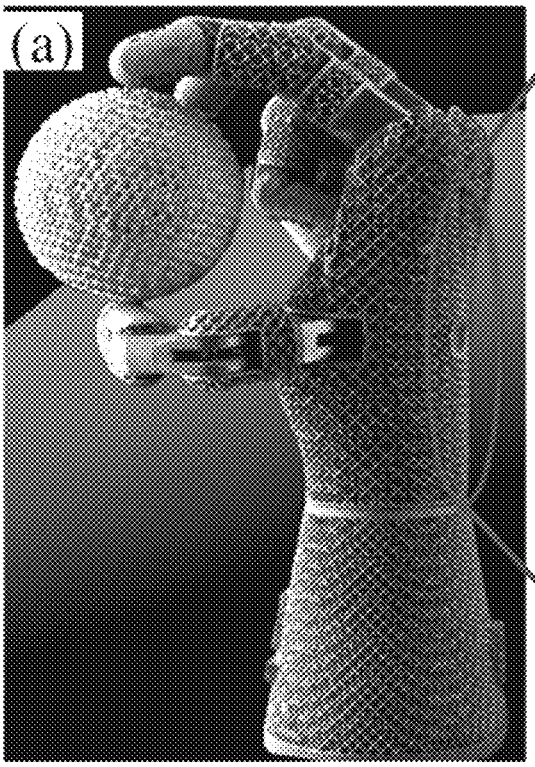
Figure 22B:
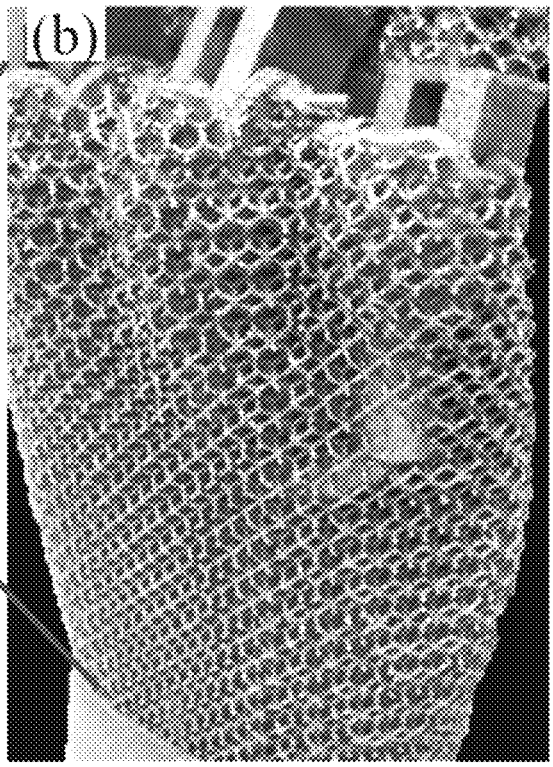
Figure 22C:
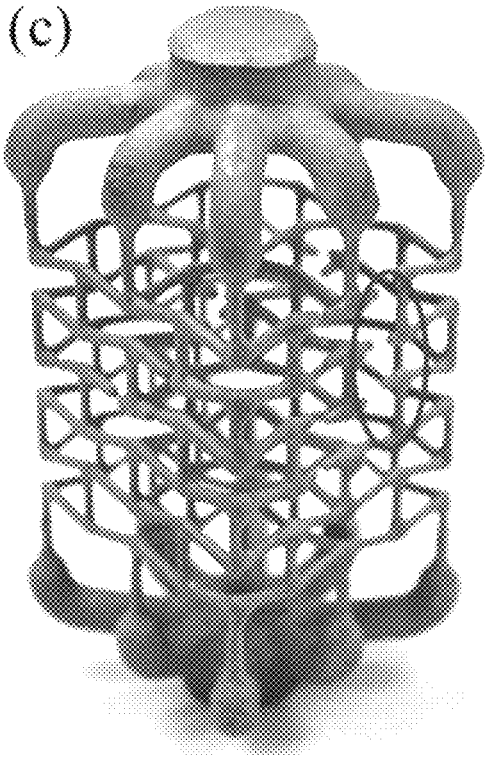

FIGS. 16-17 show various types of structures that can be made with the AMWB machine, while FIGS. 18A-20 show the resulting structures. FIGS. 21-22H show a comparison of the AMWB machine structures to other types of fabricated 3-dimensional structures as well as the superiority of the AMWB manufactured 3-dimensional structures (green).

All publications, patents, and patent applications mentioned in this specification are herein incorporated by reference to the same extent as if each individual publication, patent, or patent application was specifically and individually indicated to be incorporated by reference, including the references set forth in the following list:

REFERENCES

1) Mun, J., B.-G. Yun, J. Ju and B.-M. Chang, *Indirect additive manufacturing based casting of a periodic 3D cellular metal—Flow simulation of molten aluminum alloy,* 17 Journal of Manufacturing Processes 28-40 (2015).
2) Queheillalt, D. T. and H. N. G. Wadley, *Titanium alloy lattice truss structures,* 30 Materials & Design 1966-1975 (2009).
3) Schaedler, T. A., A. J. Jacobsen, A. Torrents, A. E. Sorensen, J. Lian, J. R. Greer, L. Valdevit and W. B. Carter, *Ultralight Metallic Microlattices,* 334(6058) Science 962-965 (2011).
4) Sennewald, C., S. Kaina, D. Weck, A. Gruhl, M. Thieme, G. Hoffmann, G. Stephani, R. Bohm, C. Cherif, O. Andersen, B. Kieback and W. A. Hufenbach, *Metal Sandwiches and Metal-Matrix-Composites Based on 3D Woven Wire Structures for Hybrid Lightweight Construction,* 16(10) Advanced Engineering Materials 1234-1242 (2014).
5) Wadley, H. N. G., K. P. Dharmasena, M. R. O'Masta and J. J. Wetzel, *Impact response of aluminum corrugated core sandwich panels,* 62 International Journal of Impact Engineering 114-128 (2013).
6) Zheng, X., H. Lee, T. H. Weisgraber, M. Shusteff, J. DeOtte, E. B. Duoss, J. D. Kuntz, M. M. Biener, Q. Ge, J. A. Jackson, S. O. Kucheyev, N. X. Fang and C. M. Spadaccini, *Ultralight, ultrastiff mechanical metamaterials,* 344(6190) Science 1373-1377 (2014).

What is claimed is:

1. A wire bending apparatus comprising:

a feeding system;

a first control platform axis including first parallel guides, a first movable carriage supported by the first parallel guides, and a first bending unit attached to the first moveable carriage; and a second control platform axis including second parallel guides, a second movable carriage supported by the second parallel guides, and a second bending unit attached to the second moveable carriage;

wherein the first parallel guides are on a horizontal plane;

wherein the second parallel guides are on a vertical plane; and wherein the horizontal plane is orthogonal to the vertical plane.

2. The apparatus of claim 1, wherein the feeding system comprises at least one feed roller pair and a controllable feed motor.

3. The apparatus of claim 2, wherein the at least one feed roller pair comprises a first feed roller pair and a second feed roller pair.

4. The apparatus of claim 2, wherein each feed roller pair includes a primary roller coupled to a pulley and a secondary roller coupled to a top plate of the wire bending apparatus.

5. The apparatus of claim 4, wherein a drive belt couples the pulley to the controllable feed motor.

6. The apparatus of claim 2, wherein each feed roller pair includes a primary roller coupled to a gear and a secondary roller coupled to a top plate of the wire bending apparatus.

7. The apparatus of claim 6, wherein the gear engages directly with the controllable feed motor.

8. The apparatus of claim 7, wherein the first movable carriage is coupled to a first controllable carriage driving motor.

9. The apparatus of claim 7, wherein the first bending unit comprises a first bending tool coupled to a first bending motor, the first bending tool including a first shank and a first head, and the first bending motor providing rotational motion to the first bending tool.

10. The apparatus of claim 9, wherein the first head comprises two adjustable pins in a slot or fork configuration.

11. The apparatus of claim 7, wherein the second movable carriage is coupled to a second controllable carriage driving motor.

12. The apparatus of claim 7, wherein the second bending unit comprises a second bending tool coupled to a second bending motor, the second bending tool including a second shank and a second head, and the second bending motor providing rotational motion to the second bending tool.

13. The apparatus of claim 12, wherein the second head comprises two adjustable pins in a slot or fork configuration.

14. A method of bending a wire, the method comprising:

i) providing the apparatus of claim 1;

ii) advancing a wire with the feeding system;

iii) engaging the wire with the first bending unit;

iv) bending the wire with the first bending unit;

v) retracting the first bending unit; and optionally repeating steps ii-v to form a desired structure.

15. The method of claim 14, wherein engaging the wire with the first bending unit comprises moving the first movable carriage of the first control platform axis with a first controllable carriage driving motor to position the wire between two adjustable pins on the first bending unit, the moving of the first movable carriage being controlled by an algorithm.

* * * * *